US006842529B2

(12) United States Patent
Koura et al.

(10) Patent No.: US 6,842,529 B2
(45) Date of Patent: Jan. 11, 2005

(54) SPEAKER

(75) Inventors: Satoshi Koura, Mie (JP); Takashi Suzuki, Mie (JP); Hiroyuki Takewa, Osaka (JP); Mitsukazu Kuze, Osaka (JP); Mitsuhiro Hasegawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 23 days.

(21) Appl. No.: 10/129,191

(22) PCT Filed: Sep. 4, 2001

(86) PCT No.: PCT/JP01/07637

§ 371 (c)(1),
(2), (4) Date: Aug. 20, 2002

(87) PCT Pub. No.: WO02/21880

PCT Pub. Date: Mar. 14, 2002

(65) Prior Publication Data

US 2003/0053651 A1 Mar. 20, 2003

(30) Foreign Application Priority Data

Sep. 4, 2000 (JP) ..... 2000-266823
Mar. 12, 2001 (JP) ..... 2001-68933

(51) Int. Cl.[7] ..... H04R 25/00

(52) U.S. Cl. ..... 381/403; 381/407; 381/412; 381/420

(58) Field of Search ..... 381/396, 398, 381/400, 403, 404, 409, 410, 412, 416, 420, 407, 397, 414; 181/171

(56) References Cited

U.S. PATENT DOCUMENTS 5,081,684 A 1/1992 House
6,088,466 A * 7/2000 Proni ..... 381/397

FOREIGN PATENT DOCUMENTS

| | | |
|---|---|---|
| JP | 55-064500 | 5/1980 |
| JP | 2756037 | 3/1998 |
| JP | 2000-278791 | 10/2000 |
| WO | 90/05435 | 5/1990 |

* cited by examiner

*Primary Examiner*—Huyen Le
(74) *Attorney, Agent, or Firm*—Wenderoth, Lind & Ponack, L.L.P.

(57) ABSTRACT

A loudspeaker includes a bobbin, a coil, a magnetic circuit having a magnetic gap, a first cylinder fixed to the outer surface of the bobbin, a second cylinder connected with the first cylinder, a diaphragm and a damper coupled to the outer circumferential surface of the second cylinder, an edge coupled to the diaphragm, a frame, and terminals. The outer circumference of a yoke constituting the magnetic circuit has a plurality of slits, while the first cylinder and the second cylinder are connected together by a plurality of radially-disposed joints. The loudspeaker has a flat profile yet is compatible with large amplitude and high output power, and capable of reproducing a wide range of sounds from a low tone to a high tone.

33 Claims, 37 Drawing Sheets

(a)

(b)

(a)

(b)

A - 0 - B

A - O - B

A – 0 – B

A - 0 - B

A – 0 - B

SPEAKER

TECHNICAL FIELD

The present invention relates to an electrodynamic loudspeaker (speaker) for use in consumer and professional fields.

BACKGROUND ART

In recently developed space-saving sound apparatus, a space designated for mounting a speaker is limited. Thus, the speaker is requested to have a compact and flat profile, as well as be light in weight. At the same time, in order to comply with an increased dynamic range of digital sound sources, the speaker is requested to be compatible with large outputs.

A conventional speaker used in the above environment is described referring to FIG. 38 and FIG. 39. FIG. 38 is a cross sectional view of a conventional outer magnet type speaker, while FIG. 39 shows a cross sectional view of a conventional inner magnet type speaker.

Referring to FIG. 38, a conventional outer magnet type speaker comprises a magnetic circuit 51 formed of a bottom plate 42 having a center pole 41; a cylindrical magnet 43 disposed on the bottom plate 42 and an upper plate 44 disposed on the magnet; a frame 52 attached on the magnetic circuit 51; a voice coil 53 having a coil 53*a*; a damper 54; a diaphragm 55; a dust cap 57; and a lead wire 58 which is connected at one end with the coil 53*a*, and at another end with a terminal 59, for feeding input signals delivered from outside of the speaker. A conventional inner magnet type speaker of FIG. 39 is structured likewise, except for an existence of a center pole 41, and a positioning of the magnet 43.

The total height of a speaker equals a sum of the total height of magnetic circuit 51, a distance from the upper end of the magnetic circuit 51 to damper 54 including an amplitude margin and a height of diaphragm 55 disposed above the damper 54. This means that if a speaker is to be made more flat, the height above the magnetic circuit 51 needs to be reduced. Namely, the height of diaphragm 55 needs to be reduced. Furthermore, a vertical distance between an outer circumference of damper 54 and the coil 53*a* is made to be greater than a vertical distance between an outer circumference of an edge 56, or the fixed end of the speaker supporting system, and an outer circumference of the damper 54.

However, a diaphragm 55 of lower height is structurally strong in strength in the vibrating direction. This means that such a diaphragm is not suitable for a high output speaker, and the threshold frequency at high frequency range sound reproduction becomes low. In order to maintain a certain strength with a diaphragm 55 of low profile, the diaphragm 55 needs to have a greater thickness; which leads to an increased weight, and the increased strength inevitably decreases the efficiency of a speaker. Meanwhile, when the vertical distance between the outer circumference of damper 54 and the coil 53*a* is made to be greater than the vertical distance between the outer circumference of an edge 56 and the outer circumference of the damper 54, the center of gravity of the vibration system shifts towards the coil side, or goes down, which makes the vibrating motion unstable. Therefore, the above-described configuration is not suitable for a high output application; especially, for reproduction of heavy bass sounds where a diaphragm moves in large amplitudes. Furthermore, many of the conventional flat-profile speakers have been exposed during operation to a risk of breakage at the connecting part between the outer circumference of voice coil 53 and the inner circumference of damper 54 due to insufficient adhesive strength.

As is described above, if a speaker is modified into a flat-profile keeping the basic conventional structure as it is, the modified speaker becomes unsuitable for high-output and great-amplitude application.

Another example of a flat-profile speaker is disclosed in Japanese Patent No. 2756037 (International Publication No.: WO90/05435). The speaker is provided in at least one of the magnetic poles with openings, which extend parallel to a magnetic gap and a moving direction of a voice coil. Ribs for fixing the voice coil and a flat diaphragm together are inserted in the opening in order to transfer a vibration of the voice coil to the diaphragm. The diaphragm is substantially thick and has a flat structure, because it is directly connected with the voice coil.

The speaker of Patent No. 2756037, however, can not employ an ordinary voice coil because of the rib. In the speaker, a coil is adhered onto the inside of a bobbin fixed to the diaphragm; which means that it needs an extra step of adhering during assembly of a speaker. Further, because there is no mechanical engagement between the coil and the bobbin, the connecting strength is solely dependent on adhesive strength of the adhesives. As a result, a temperature withstanding capability of a speaker is limited by a heat resistive property of the adhesives. Thus, the speaker of the above-described configuration is not suitable for use in a high input power. Furthermore, the thick diaphragm of the speaker makes it inappropriate for the high frequency sound reproduction.

DISCLOSURE OF THE INVENTION

A speaker of the present invention comprises a bobbin, a coil wound around an outer surface of the bobbin, a magnetic circuit having a magnetic gap in which the coil is inserted, a first cylinder attached and fixed to an outer surface of the bobbin, a second cylinder connected to the first cylinder, a diaphragm and a damper fixed to an outer circumferential surface of the second cylinder, an edge connected to the diaphragm, a frame on which an outer circumference of the damper and the outer circumference of the edge are fixed, and terminals fixed on the frame and electrically connected with the coil.

In a speaker of the present invention, a yoke constituting the magnetic circuit is provided in the outer circumference with a plurality of slits, while the first cylinder and the second cylinder are connected together by a plurality of joints disposed in radial arrangement.

In a speaker in accordance with another embodiment of the present invention, the bobbin is connected at the outer surface in an area lower than the coil with an inner surface of the first cylinder.

A speaker in accordance with still another embodiment of the present invention has a second cylinder that is longer than the first cylinder.

In a speaker in accordance with yet another embodiment of the present invention, a first cylinder and a second cylinder are connected together at their upper ends with a ring.

Speakers provided in accordance with the present invention are suitable for use in the high output and great amplitude application, and capable of reproducing a wide frequency range of sounds from the low to high frequencies.

BRIEF DESCRIPTION OF THE DRAWINGS

FIG. 1(*b*) is a cross sectional view of the speaker.

FIG. 2(*b*) is a cross sectional view of the double cylinder.

FIG. 3(*b*) is a cross sectional view of the magnetic circuit.

FIG. 4(*b*) is a cross sectional view of the speaker.

FIG. 6(*b*) is a cross sectional view of the magnetic circuit.

FIG. 7(*b*) is a cross sectional view of the speaker.

FIG. 8(*b*) is a cross sectional view of the magnetic circuit.

FIG. 9(*b*) is a cross sectional view of the speaker.

FIG. 10(*b*) is a cross sectional view of the double cylinder.

FIG. 12(*b*) is a cross sectional view of the double cylinder.

FIG. 13(*b*) is a cross sectional view of the magnetic circuit.

FIG. 15(*b*) is a cross sectional view of the double cylinder.

FIG. 16(*b*) is a cross sectional view of the magnetic circuit.

FIG. 18(*b*) is the cross sectional view of the double cylinder.

FIG. 19(*b*) is a cross sectional view of the speaker.

FIG. 20(*b*) is a cross sectional view of the double cylinder.

FIG. 21(*b*) is a cross sectional view of the speaker.

FIG. 22(*b*) is a cross sectional view of the double cylinder.

FIG. 23(*b*) is a cross sectional view of the speaker.

FIG. 24(*b*) is a cross sectional view of the double cylinder.

FIG. 25(*b*) is a cross sectional view of the speaker.

FIG. 26(*b*) is a cross sectional view of the double cylinder.

FIG. 27(*b*) is a cross sectional view of the speaker.

FIG. 28(*b*) is a cross sectional view of the double cylinder.

FIG. 30(*b*) is a cross sectional view of the speaker.

FIG. 32(*b*) is a front view of a voice coil.

DETAILED DESCRIPTION OF THE INVENTION

First Embodiment

Figure 1:
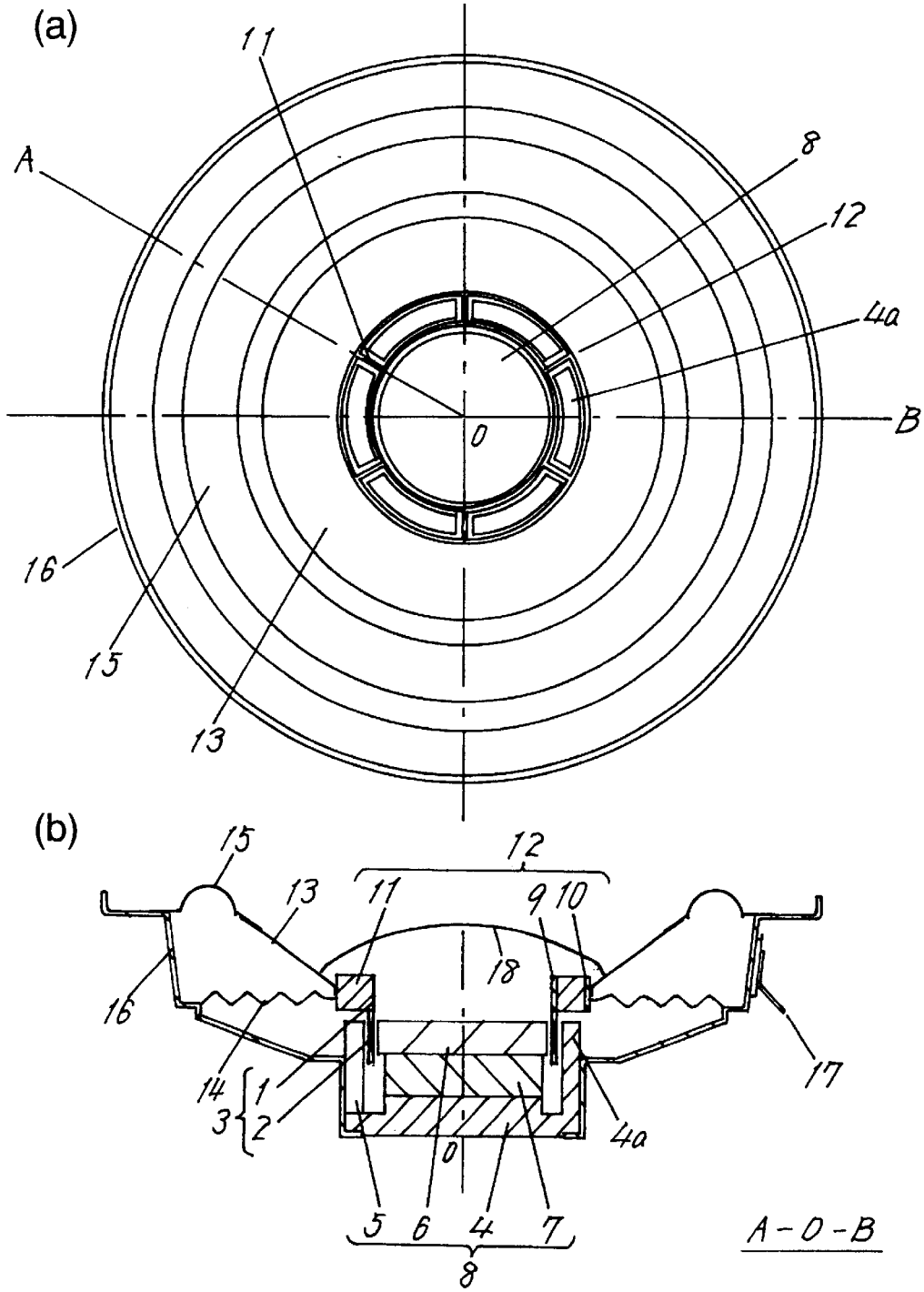
FIG. 1(*a*) is a top view of a speaker in a first exemplary embodiment of the present invention.
Figure 3:
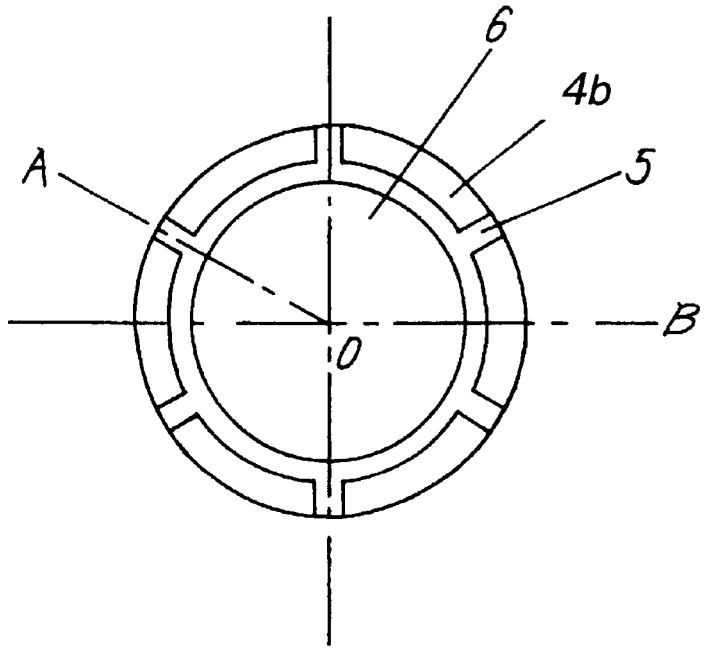
FIG. 3(*a*) is a top view of a magnetic circuit of the speaker.
Figure 3:
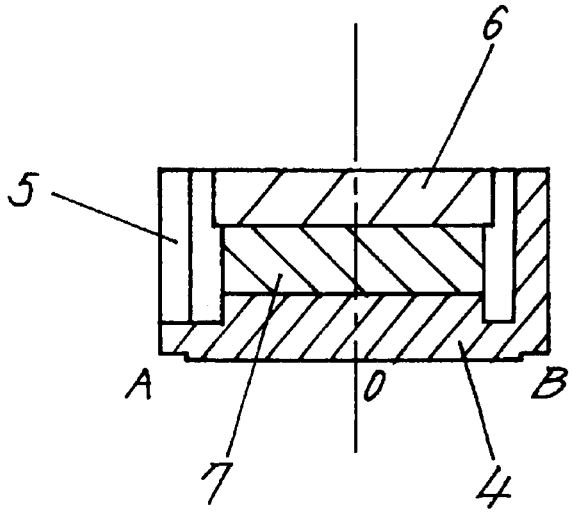

A speaker in accordance with a first exemplary embodiment of the present invention is described referring to FIG. 1(*a*) to FIG. 3(*b*). FIG. 1(*a*) is a top view of the speaker with a dust cap removed. In the subsequent embodiments, the drawings will be presented in the same style without a dust cap.

Referring to FIGS. 1(*a*) and 1(*b*), a speaker in the present embodiment 1 comprises a bobbin 1; a coil 2; a voice coil 3 formed of the bobbin 1 and the coil 2; a yoke 4; a plurality of slits 5 formed in the outer circumference 4*a* of the yoke 4; a center pole 6 whose outer circumferential surface and an inner circumferential surface of yoke 4 form a magnetic gap; a magnet 7 disposed between the yoke 4 and the center pole 6; a magnetic circuit 8 formed of the yoke 4, the slit 5, the center pole 6 and the magnet 7; a first cylinder 9; a second cylinder 10; a plurality of joints 11; a double cylinder 12 consisting of the first cylinder 9, the second cylinder 10 and the joint 11; a diaphragm 13; a damper 14; an edge 15; a frame 16; a terminal 17 fixed to the frame 16 and electrically connected with the voice coil 3; and a dust cap 18.

The structure and an operation of the speaker of the present embodiment are described below in detail.

Figure 2:
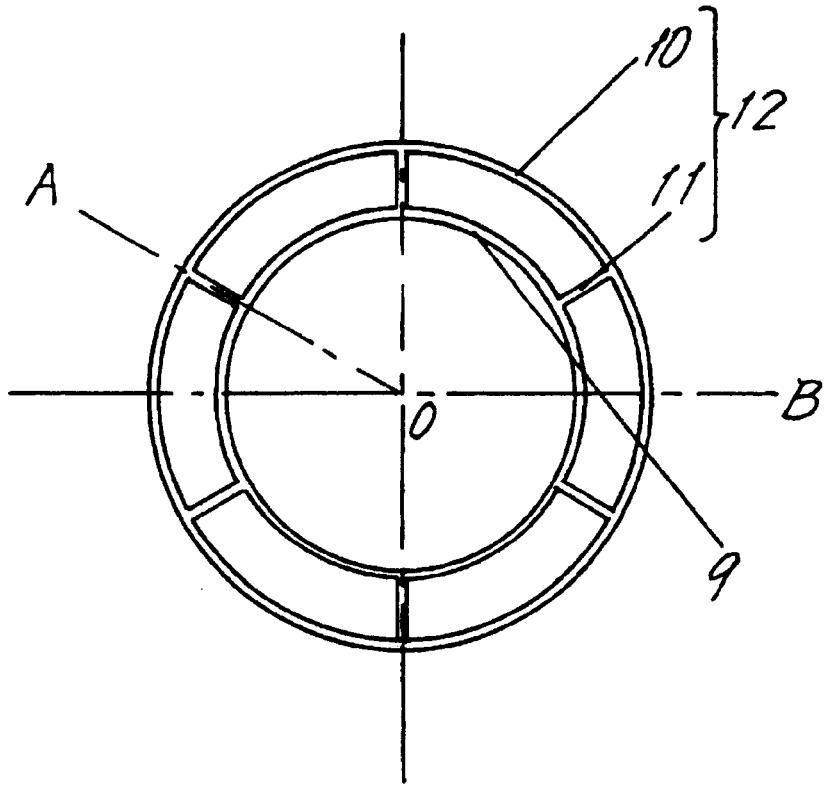
FIG. 2(*a*) is a top view of a double cylinder of the speaker.
Figure 2:
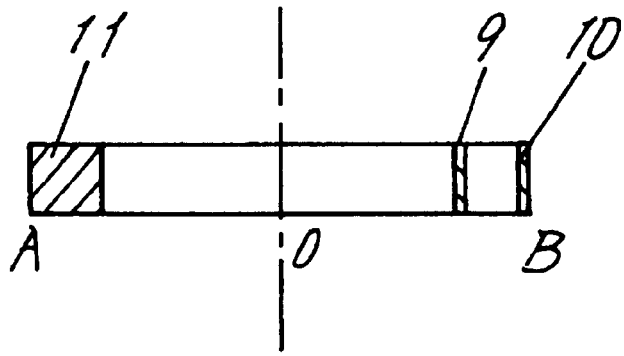

As shown in FIGS. 2(*a*) and 2(*b*), a double cylinder 12 is formed of the inner first cylinder 9 and the outer second cylinder 10 connected concentrically by the joints 11.

The outer circumference 4*a* of yoke 4 is provided with a plurality of slits 5 in a radial arrangement, as shown in FIGS. 3(*a*) and 3(*b*), and a thickness of joint 11 is smaller than a width of slit 5.

A thickness of the cylinder 9 is smaller than that of the coil 2 wound around the bobbin 1, and an inner diameter of the cylinder 9 is determined so that it fits to the outer circumference of bobbin 1. The cylinder 10 has an inner diameter that is greater than the outer diameter of an outer circumference 4*a* of the yoke 4. The inner circumference of cylinder 9 and the outer circumference of bobbin 1 are engaged at a vicinity of the upper part of coil 2, and the coil 2 is supported in the magnetic gap. The joint 11 can move within the slit 5 without making contact with the slit 5 when it moves downward, while the cylinder 10 also moves outside of the yoke 4 without making contact.

The cylinder 9 and the bobbin 1 are connected together at a place close to the coil 2 in the present embodiment, and therefore, loss of the driving force of bobbin 1 is kept to be a minimum. Since the loss of driving force is caused during transmission of a driving force generated in coil 2 via a thin and light-weight bobbin 1, the structure of the present embodiment is advantageous for improving the threshold frequency in high frequency range sound reproduction.

Furthermore, in the speaker structure of the present embodiment, a height of the bobbin 1 extending above a coil 2 is substantially the same as that of the cylinder 9, so a total height of the voice coil 3 can be made small. As a result, a possibility of the voice coil 3 colliding with the yoke 4 or with the center pole 6 can be suppressed because the collision occurs due to a deviation of the central axis of the magnetic circuit 8 and the voice coil 3 in the amplitude direction that stems from misalignment during assembly, or to a rolling motion that stems from inappropriate balance of the center of gravity of the voice coil 3.

Still further, in the present embodiment, because a bobbin 1 is engaged at the outer circumference with the inner circumference of the cylinder 9, it is possible to use a conventional voice coil 3.

Still further, since the thickness of a cylinder 9 is smaller than that of a coil 2 wound around bobbin 1, existence of the cylinder 9 does not necessitate any expansion of the magnetic gap width. Thus, a decrease in the sound pressure level of reproduced sounds can be avoided with the speaker of the present embodiment, as the decrease could have occurred due to a lowered magnetic flux density if the magnetic gap was expanded.

In accordance with the present embodiment, a damper 14 and a diaphragm 13, which used to be connected to the outer circumference of a bobbin 1, is connected to the cylinder 10 at the outer circumference. The damper 14, which used to be disposed with a certain amplitude margin above a magnetic circuit 8, is connected to the cylinder 10, and therefore, a connection point can be lowered. This means that the speaker can be made to be more flat for a length corresponding to the lowering of the damper 14. In addition, the reduced distance between the damper 14 and the lower end of the voice coil 3 makes its proportion against a distance between the outer circumference of the edge 15 connected to the frame 16 and the outer circumference of the damper 14 smaller. As a result, the center of gravity of the speaker is surely positioned between the outer circumference of the edge 15 and the outer circumference of the damper 14, which leads to an increased stability of the diaphragm during use. Thus, a flat profile speaker capable of accepting large amplitude can be obtained in accordance with the present embodiment.

Under the above-described structure, a difference in the total height relative to a conventional speaker becomes more significant with a speaker having a greater diaphragm amplitude, or a speaker having a higher basic performance. Thus, the advantage offered by the present invention reveals its significance in a speaker of flat profile that is capable of handling large amplitude.

When a magnetic circuit 8 is provided with two slits 5 which are at least adjacent to the terminal 17, among the plurality of slits, and the two slits 5 are located with an equal distance from the terminal 17, the lead wires from the voice coil 3 can be taken out through the double cylinder 12 at the location of the slits 5, or along the joints 11, at a shortest lead length and with a good balance in the weight.

Second Embodiment

Figure 4:
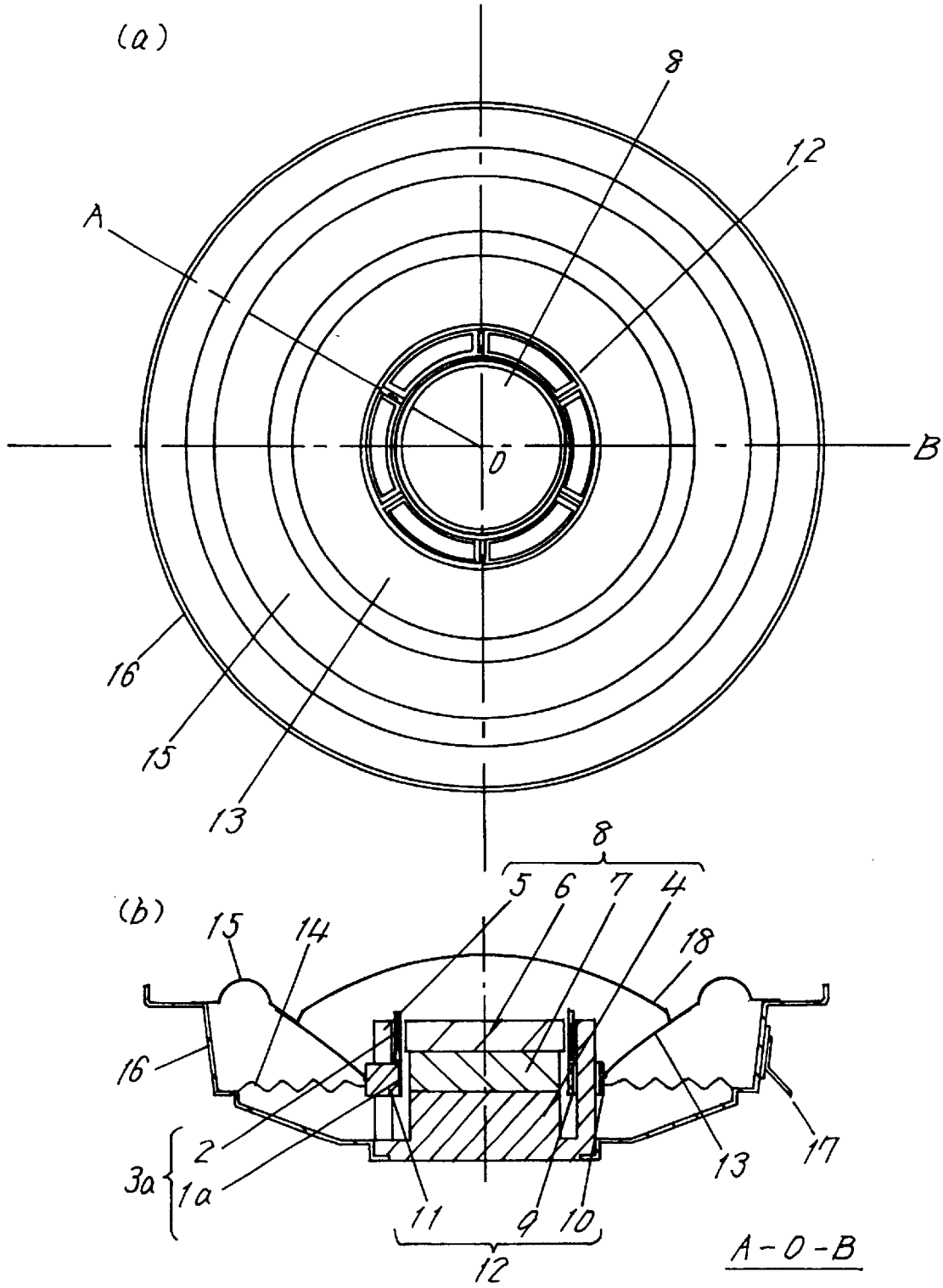
FIG. 4(*a*) is a top view of a speaker in a second exemplary embodiment of the present invention.

A speaker in accordance with a second exemplary embodiment of the present invention is described referring to FIGS. 4(*a*) and 4(*b*). In the descriptions of the following embodiments, the same elements as in the first embodiment are shown by using the same reference numerals, and a description of these elements is therefore omitted.

The difference with the speaker in the first embodiment is that, as shown in FIG. 4(*b*), a bobbin 1*a* of voice coil 3*a* is provided underneath the coil 2, and the outer circumference of bobbin 1*a* is coupled with a first cylinder 9 at the inner circumference.

As a result of coupling the outer circumference of bobbin 1*a* with the inner circumference of cylinder 9 at the vicinity of bottom end of the coil 2, the double cylinder 12 is located below the voice coil 3*a*. A distance between the outer circumference of edge 15 and the outer circumference of damper 14 can be made greater, and the center of gravity of the voice coil 3 and the vibrating system comes within the distance. The above-described structure provides a quite stable vibration in great amplitude.

Third Embodiment

Figure 5:
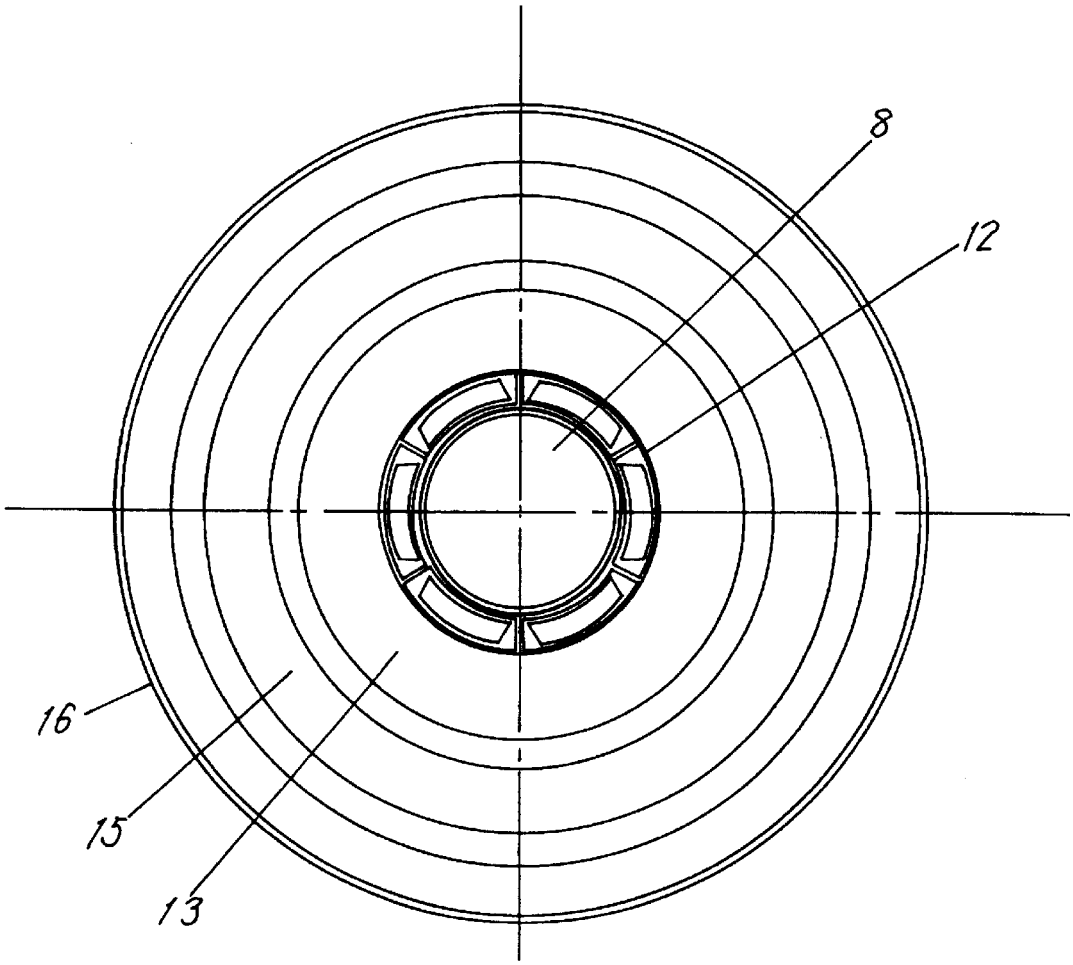
FIG. 5 is a top view of a speaker in a third exemplary embodiment of the present invention.
Figure 6:
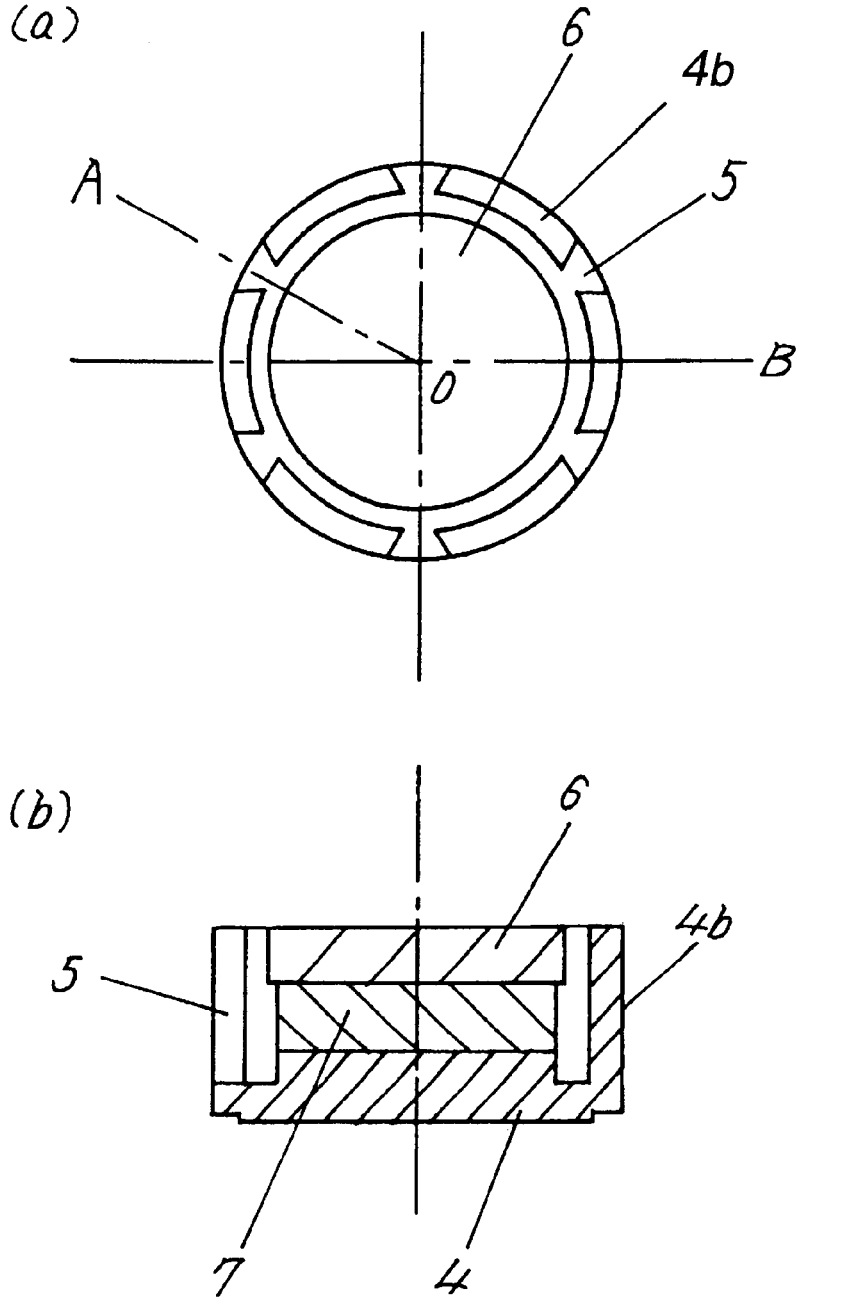
FIG. 6(*a*) is a top view of a magnetic circuit of the speaker.

A speaker in accordance with a third exemplary embodiment is described referring to FIG. 5 and FIGS. 6(*a*) and 6(*b*).

The difference with the first embodiment is that, as shown in FIG. 6(*a*), a circumference 4*b* of yoke 4 between adjacent slits 5 has an equal length both in the outer circumference and in the inner circumference. With the above-described configuration, it becomes easier to produce the yoke 4 having slits 5, viz., it can be provided by punching a sheet of a hard magnetic material into a shape of a gear wheel and bending the teeth portions. In this way, the outer circumference 4*b* can be provided without a laborious machining process of forming the slits 5; which contributes to reduce a cost for forming the yoke 4.

Fourth Embodiment

Figure 7:
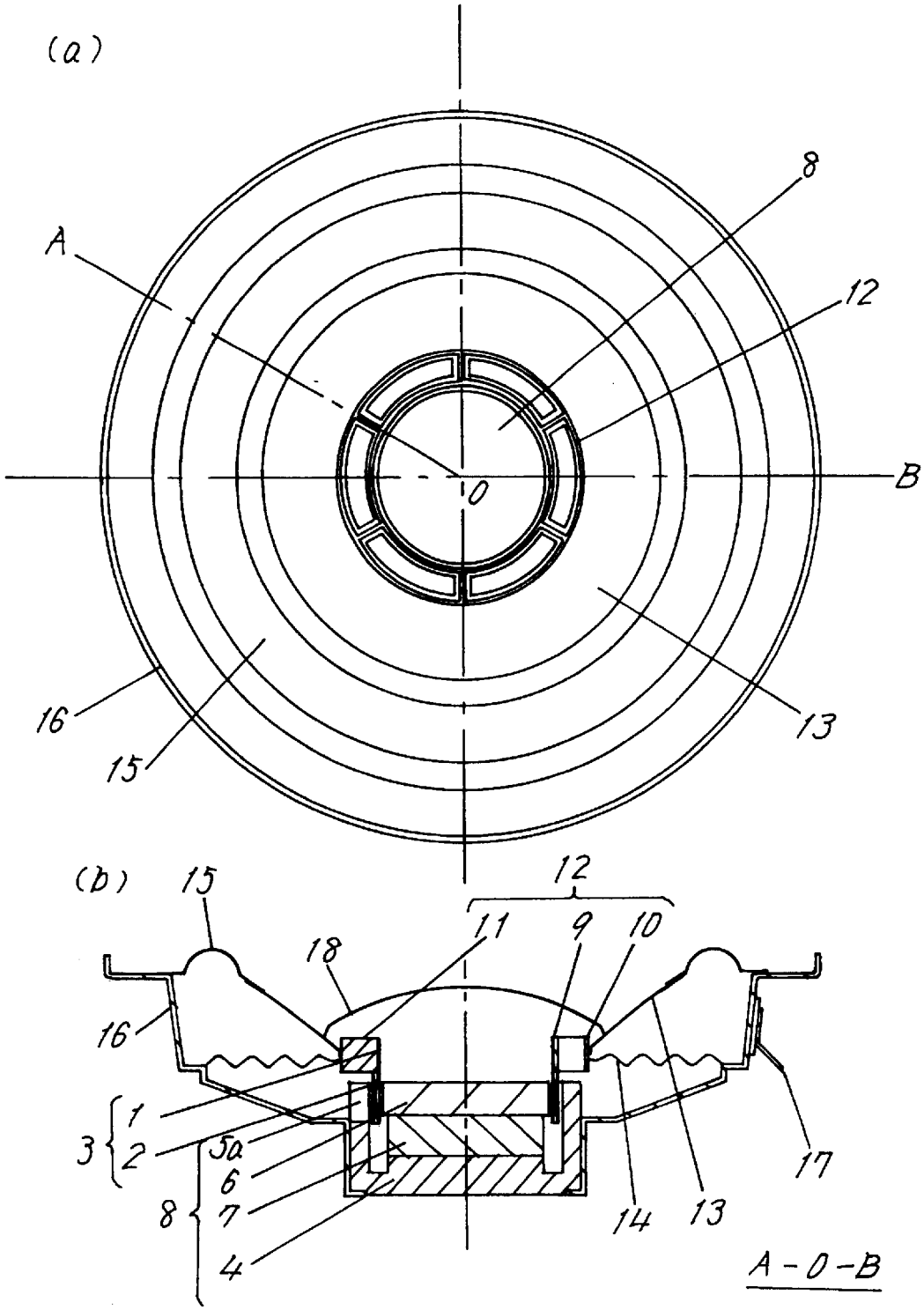
FIG. 7(*a*) is a top view of a speaker in a fourth exemplary embodiment of the present invention.
Figure 8:
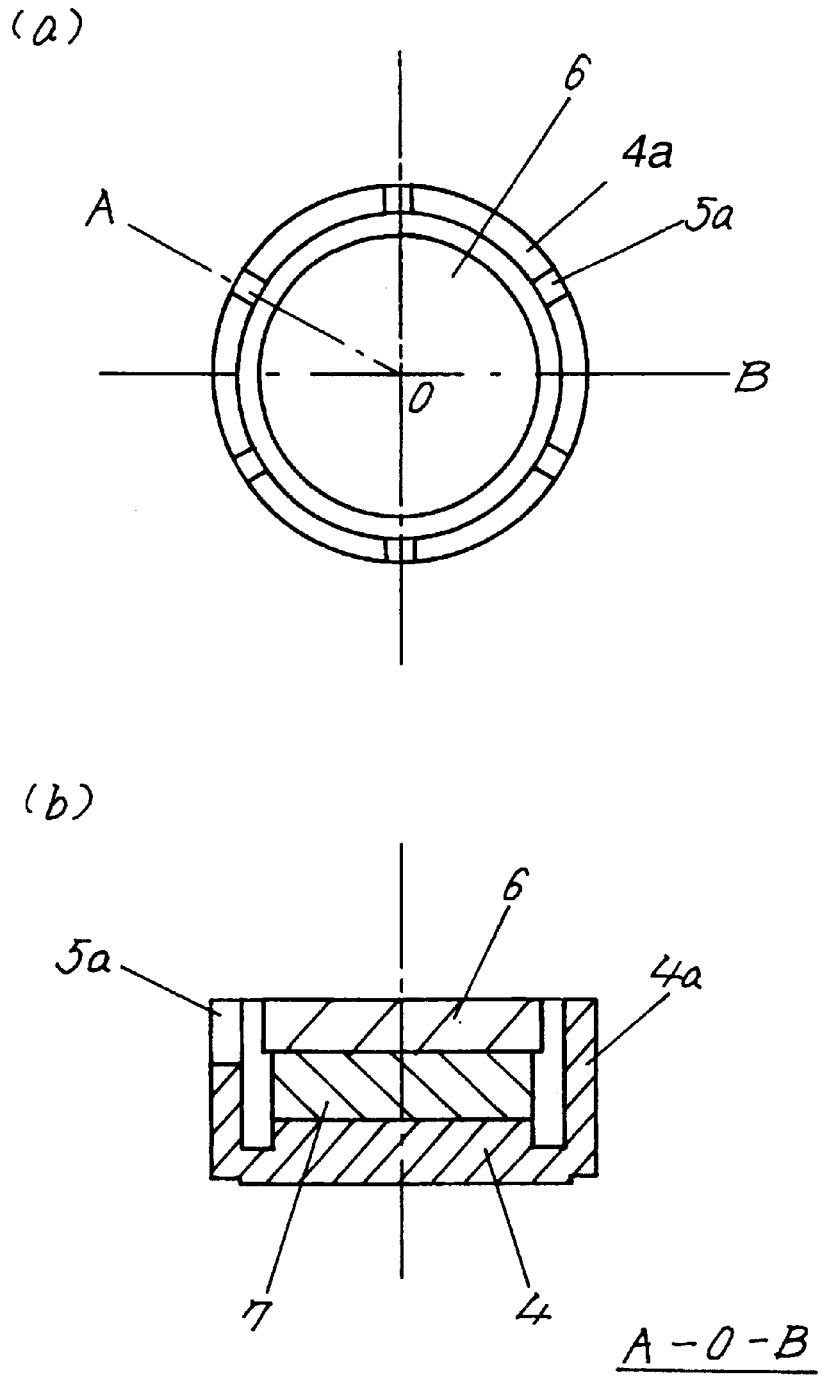
FIG. 8(*a*) is a top view of a magnetic circuit of the speaker.

A speaker in accordance with a fourth exemplary embodiment of the present invention is described referring to FIGS. 7(*a*) and 7(*b*), and FIGS. 8(*a*) and 8(*b*).

The difference with the first embodiment is that, as shown in FIG. 8(*b*), the bottom end of a slit 5*a* is halfway in the outer circumference 4*a* of yoke 4.

The minimum requirement for the slit 5*a* is to provide the joint 11 with a downward amplitude margin. So, by limiting the length of slit 5*a* to a minimum, cross sectional areas of the outer circumference 4*a* of yoke 4 for the portions where there are no slits 5*a* can be increased. As a result, a thickness of the yoke 4 needed for providing magnetic flux in the same density at the magnetic gap can be reduced. The diameter of the second cylinder 10 can be reduced accordingly, which leads to a reduced weight of the double cylinder 12 to provide a higher efficiency speaker.

Fifth Embodiment

Figure 9:
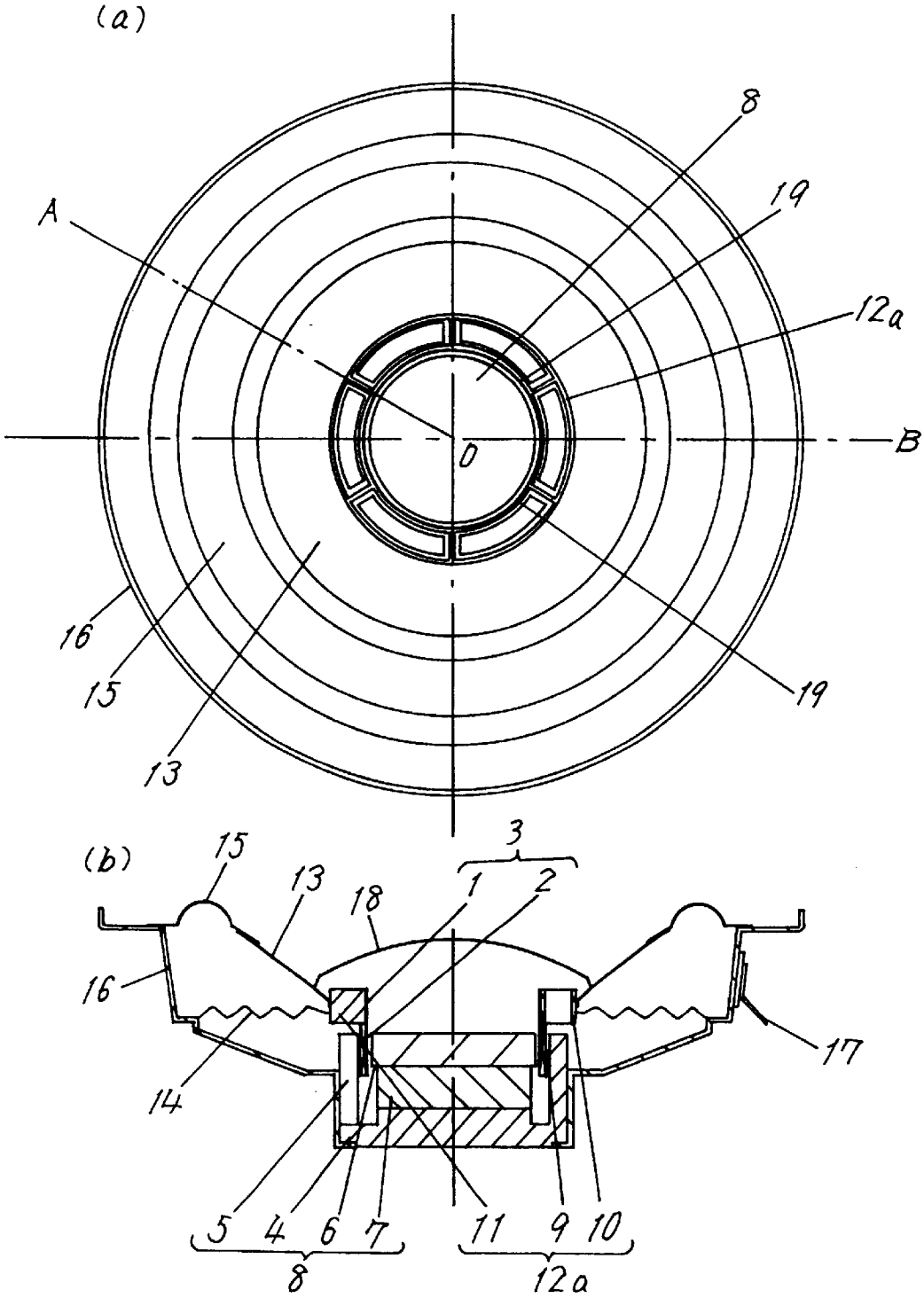
FIG. 9(*a*) is a top view of a speaker in a fifth exemplary embodiment of the present invention.
Figure 10:
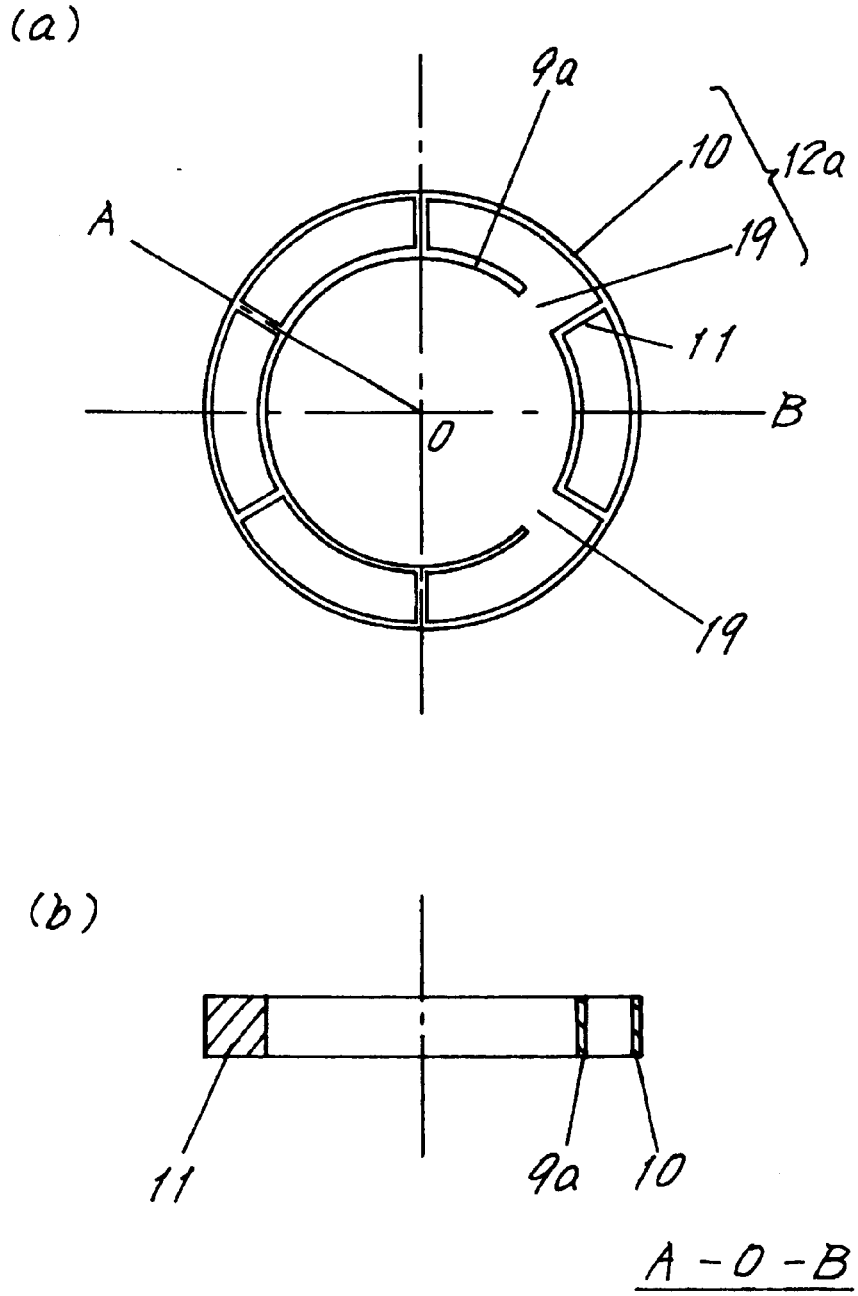
FIG. 10(*a*) is a top view of a double cylinder of the speaker.

A speaker in accordance with a fifth exemplary embodiment of the present invention is described referring to FIGS. 9(*a*) and 9(*b*), and FIGS. 10(a) and 10(*b*).

The difference with the first embodiment is that, as shown in FIG. 10(*a*), a first cylinder 9*a* is provided with a cut 19 for allowing a lead wire to travel along the cut 19 in a vertical direction. When taking a lead wire (not shown) from the coil 2 out towards an upward direction along the outer circumference of bobbin 1, the lead wire does not need to go through a tightly adhered space between the outer circumference of the bobbin 1 and the inner circumference of the first cylinder 9*a*. This makes the assembly operation of speakers easier.

Although FIG. 10(*a*) shows two cuts 19, the present invention is not limited to such a location and such a number. Only one cut 19 may be provided, or the cut 19 may be provided by breaking the first cylinder 9*a* between the adjacent joints 11.

The structure in the present embodiment may be introduced in those speakers of the first, the second and fourth embodiments to yield the same advantage.

Sixth Embodiment

Figure 11:
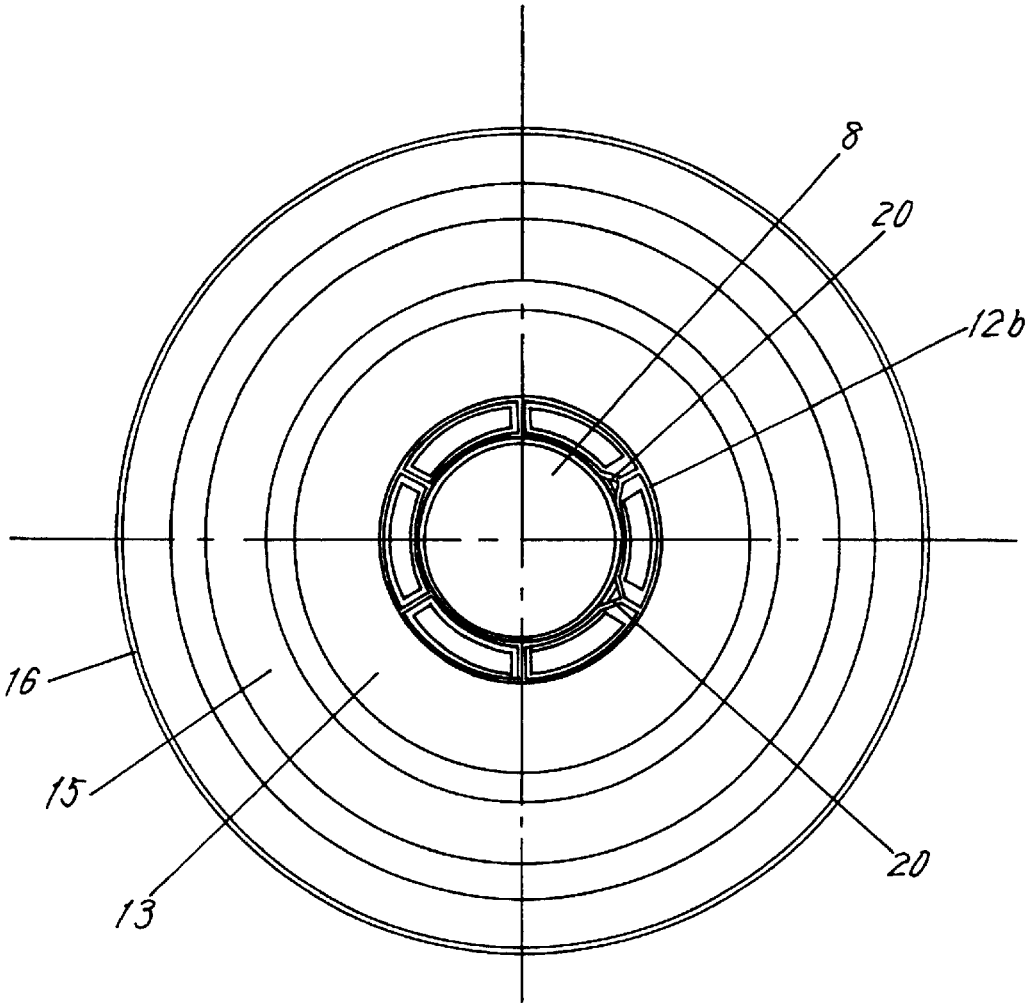
FIG. 11 is a top view of a speaker in a sixth exemplary embodiment of the present invention.
Figure 12:
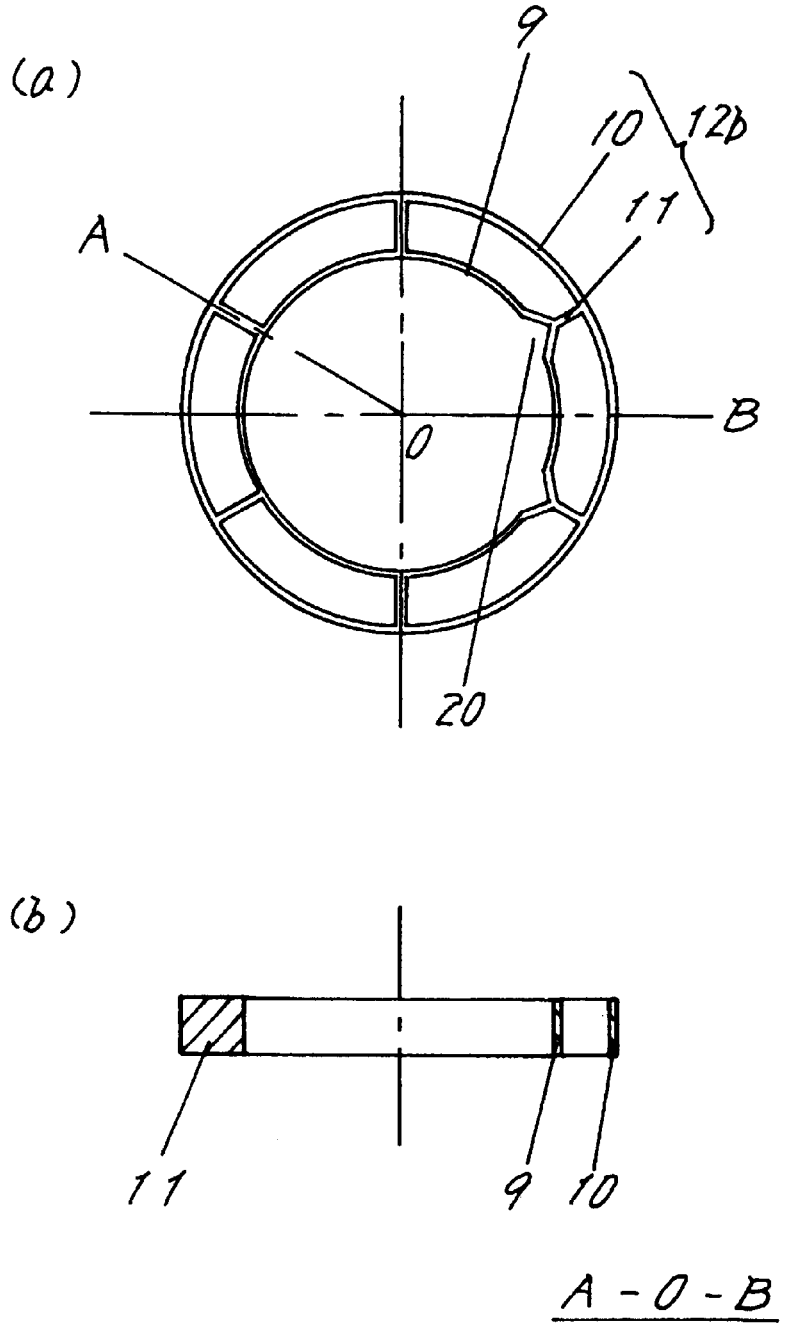
FIG. 12(*a*) is a top view of a double cylinder of the speaker.
Figure 13:
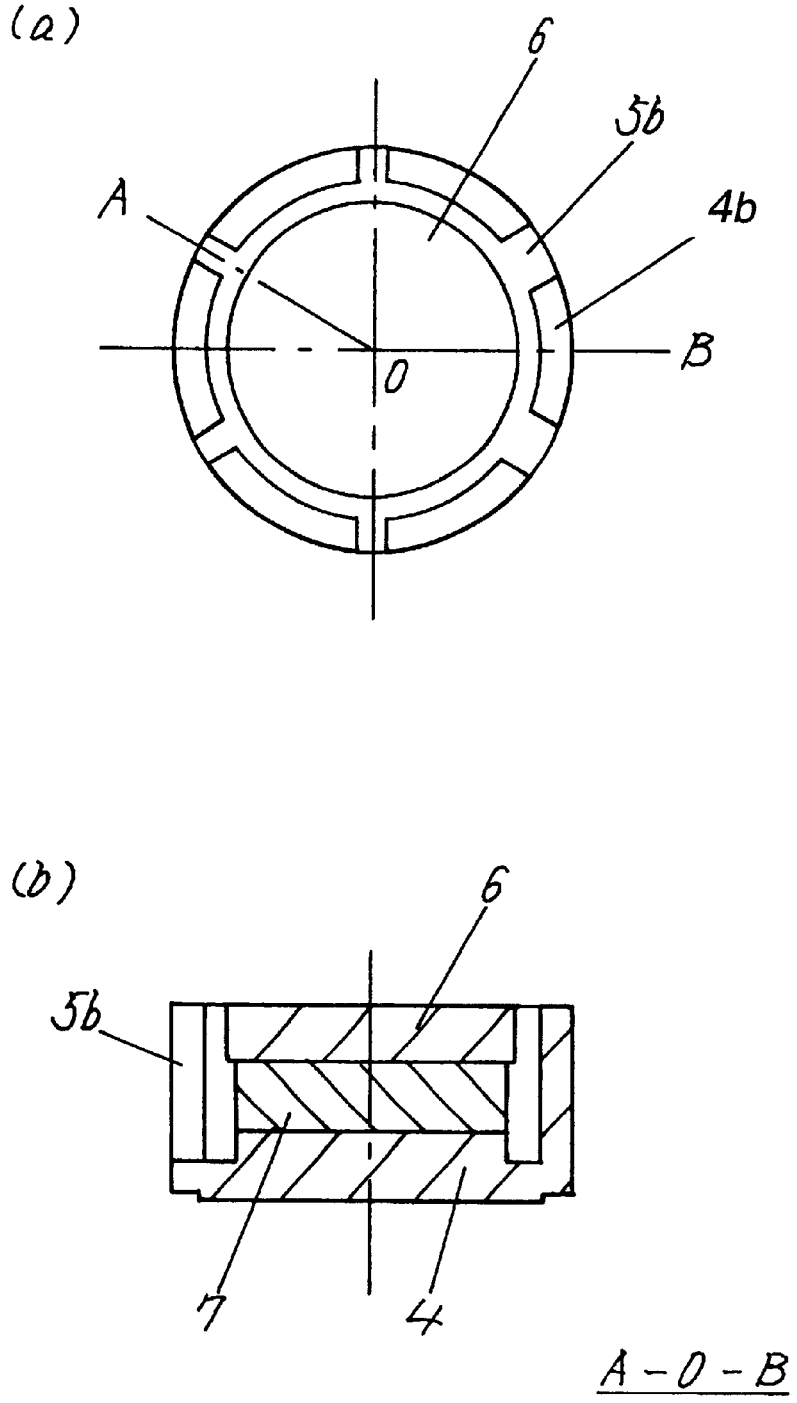
FIG. 13(*a*) is a top view of a magnetic circuit of the speaker.

A speaker in accordance with a sixth exemplary embodiment of the present invention is described referring to FIG. 11, FIGS. 12(*a*) and 12(*b*), and FIGS. 13(*a*) and 13(*b*).

The difference with the first embodiment is that, as shown in FIG. 12(*a*), the first cylinder 9*a* is provided at a place of connection with the joint 11 with a bent part 20 protruding along the radial direction, and there is an expanded slit 5*b*, as shown in FIG. 13(*a*), so that the cylinder 9 at the bent part 20 is kept to be free from making contact with the outer circumference 4*a* of yoke 4. The bent part 20 facilitates a lead wire of coil 2 going upward along the bobbin 1, to be taken to the outside. Like in the fifth embodiment, the lead wire does not need to go through a tightly coupled space between the outer circumference of the bobbin 1 and the inner circumference of the cylinder 9, which makes the assembly operation of speakers easier.

The shape of the bent part 20 is not limited to that shown in FIG. 12, but instead, may take a curved shape. The structure in the present embodiment may be introduced to those speakers of the first, second third and fourth embodiments to yield the same advantage.

Seventh Embodiment

Figure 14:
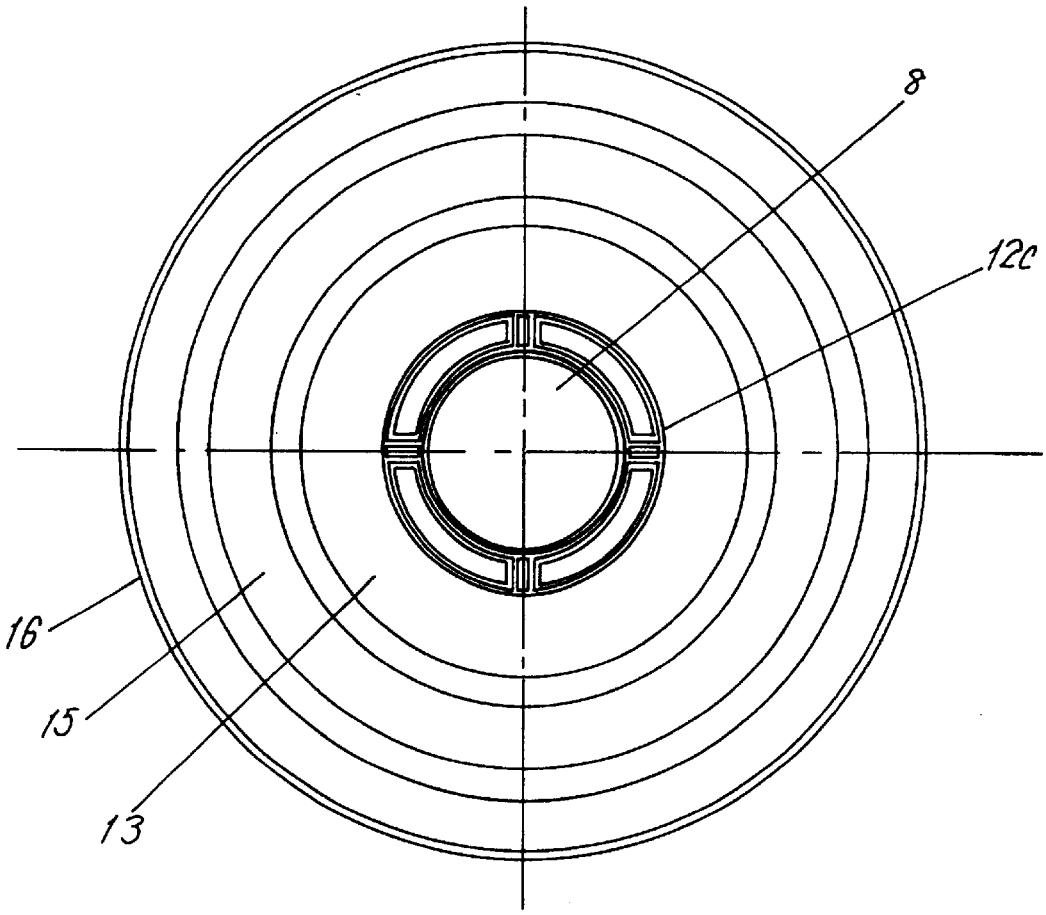
FIG. 14 is a top view of a speaker in a seventh exemplary embodiment of the present invention.
Figure 15:
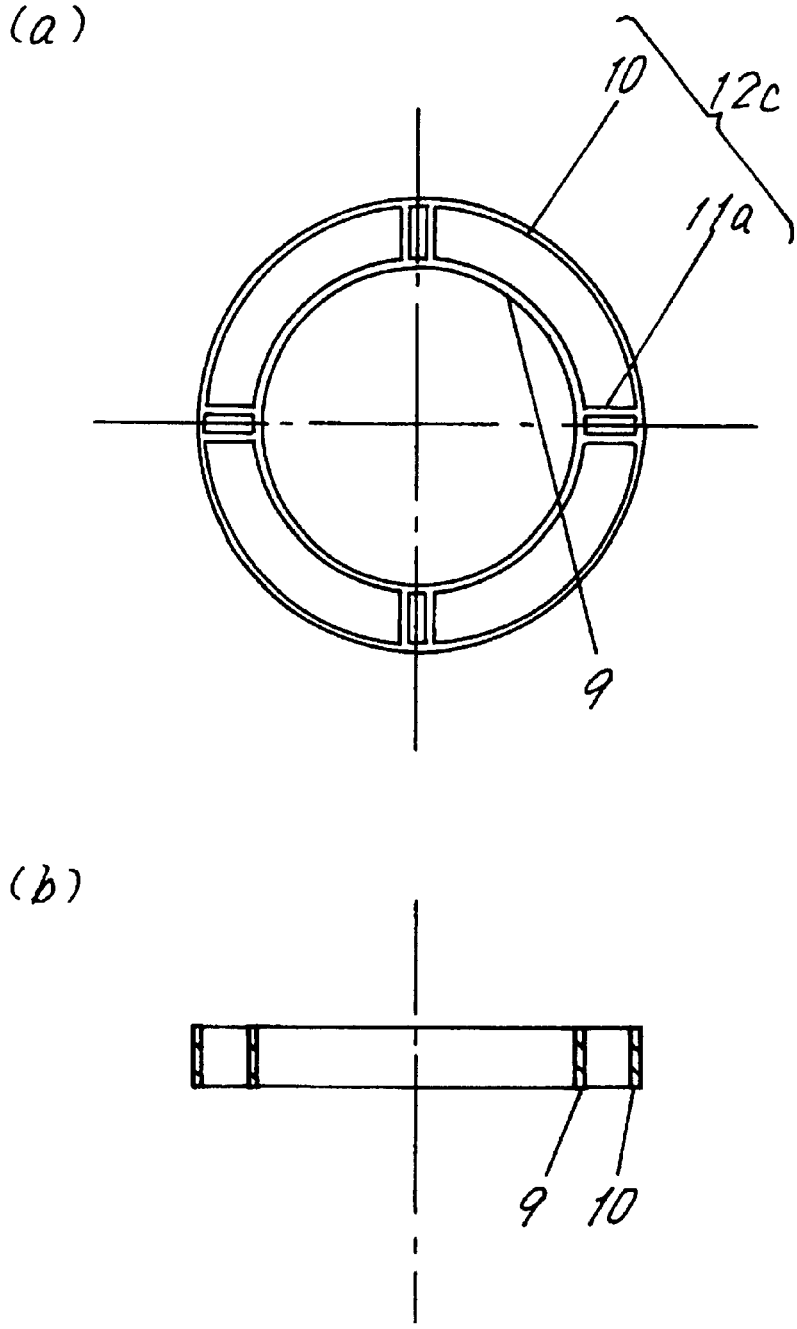
FIG. 15(*a*) is a top view of a double cylinder of the speaker.
Figure 16:
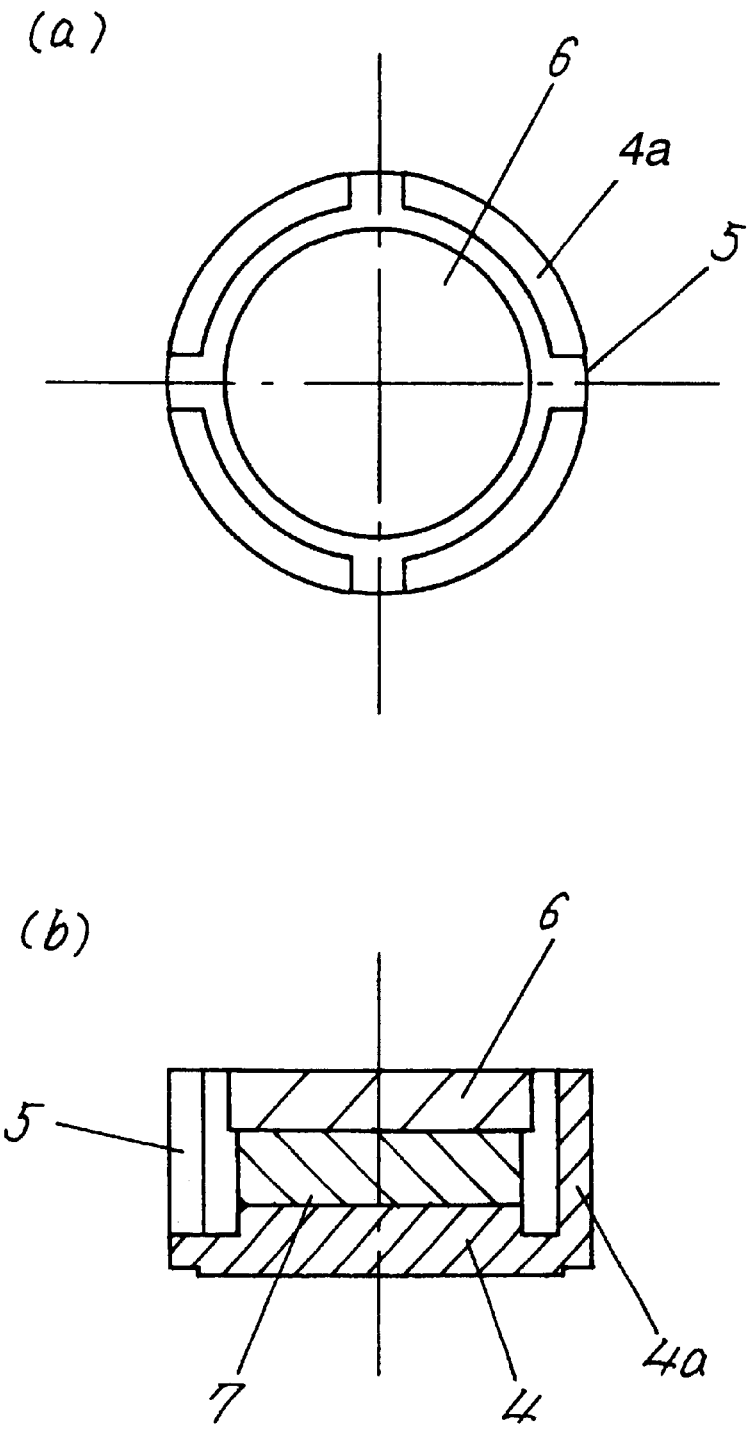
FIG. 16(*a*) is a top view of a magnetic circuit of the speaker.

A speaker in accordance with a seventh exemplary embodiment of the present invention is described referring to FIG. 14, FIGS. 15(*a*) and 15(*b*), and FIGS. 16(*a*) and 16(*b*).

The difference with the first embodiment is that, as shown in FIG. 15(*a*), there is a joint 11*a* made of two members to be inserted into one slit 5. The number of slits 5 is reduced from that in the first embodiment, and a width of slit 5 is expanded so that the double-member joint 11*a* is kept to be free from making contact with the yoke 4. By using the double-member joint 11*a*, the number of the slits 5 may be reduced without decreasing a capacity of conveying a driving force of voice coil 3 to the whole part of a double cylinder 12*c*. The reduced number of slits 5 enables an increase in the cross sectional areas of the outer circumference 4*a* of yoke 4 for the portions where there are no slits 5*a*. As a result, a yoke 4 having a smaller outer diameter in the outer circumference 4*a* can be used for providing the same level of magnetic saturation as in the first embodiment, and the diameter of second cylinder 10 can be reduced accordingly. This leads to a reduced weight of the double cylinder 12 to improve the threshold frequency of high frequency range sound reproduction.

Although the above description has been based on the use of joint 11 of two members in the speaker of the first embodiment, the double-member joint 11 may be introduced to each of the foregoing embodiments to yield the same advantage.

Eighth Embodiment

Figure 17:
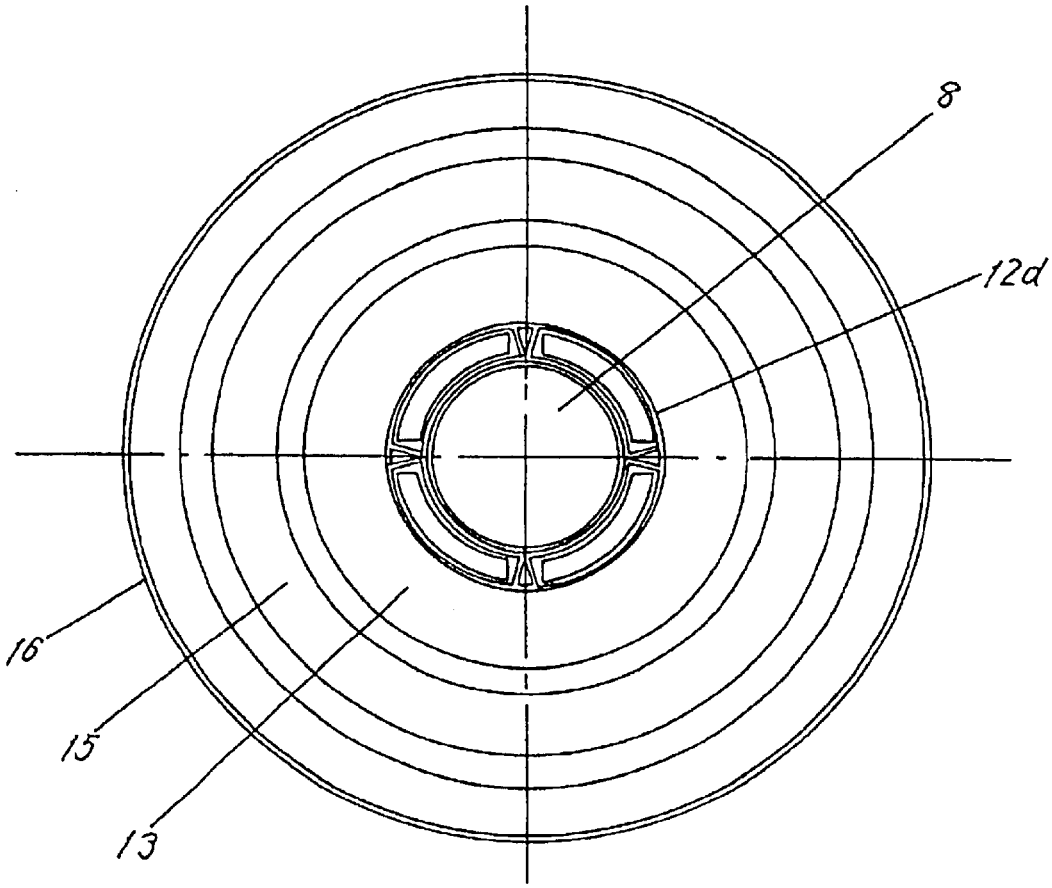
FIG. 17 is a top view of a speaker in an eighth exemplary embodiment of the present invention.
Figure 18A:
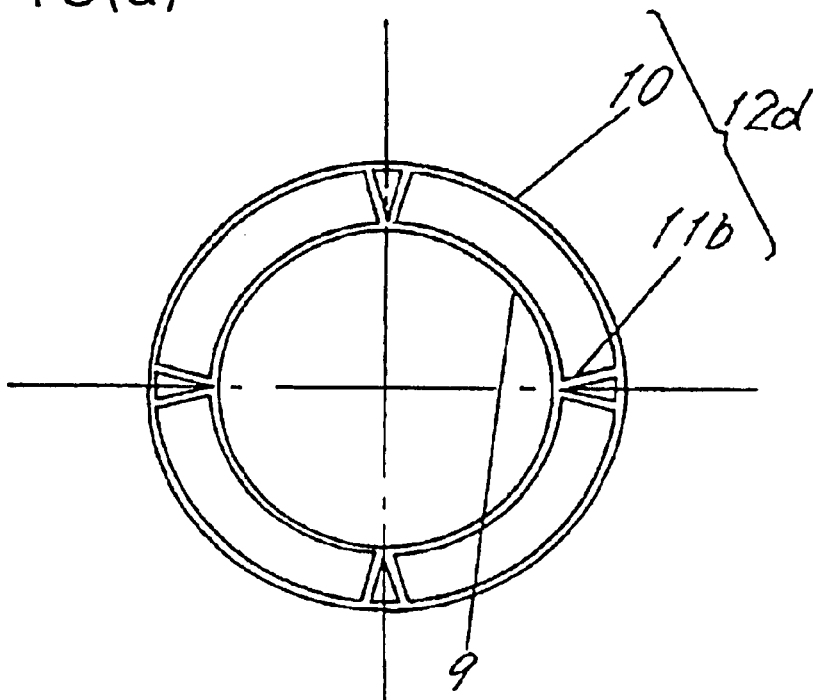
FIG. 18(*a*) is a top view of a double cylinder of the speaker.
Figure 18B:
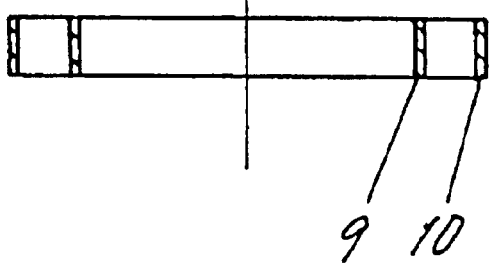

A speaker in accordance with an eighth exemplary embodiment of the present invention is described referring to FIG. 17 and FIGS. 18(*a*) and 18(*b*).

As compared with the seventh embodiment, two joints 11*b* in the present embodiment are disposed so that a distance between the two joints 11*b* increases as it goes towards the outside, as shown in FIG. 18(*a*). The joints 11*b* disposed as such increase the joining strengths between the first cylinder 9 and the second cylinder 10 in the amplitude direction and the twisting direction. Thereby, the driving force generated in voice coil 3 can be conveyed surely and totally via a double cylinder 12*d* to the diaphragm 13. Thus, threshold frequency in the high frequency range sound reproduction is increased. Furthermore, the reliability against twisting is improved, which occurs at a large amplitude of the diaphragm.

Ninth Embodiment

Figure 19A:
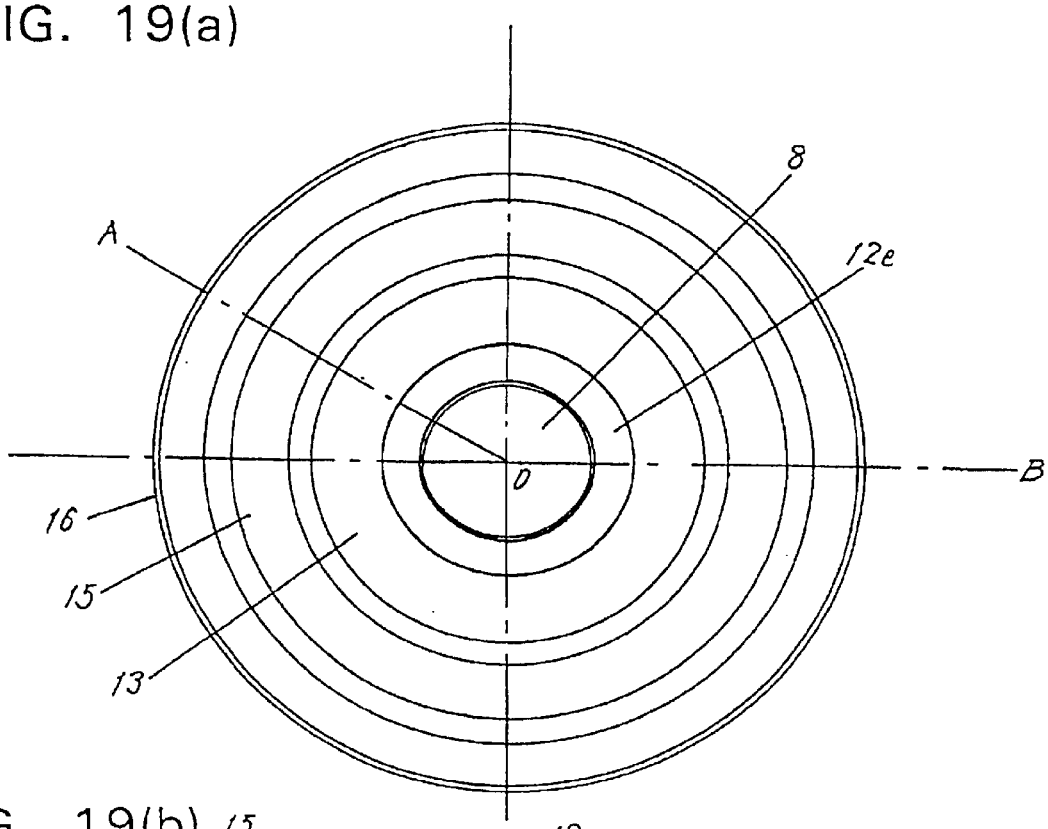
FIG. 19(*a*) is a top view of a speaker in a ninth exemplary embodiment of the present invention.
Figure 19B:
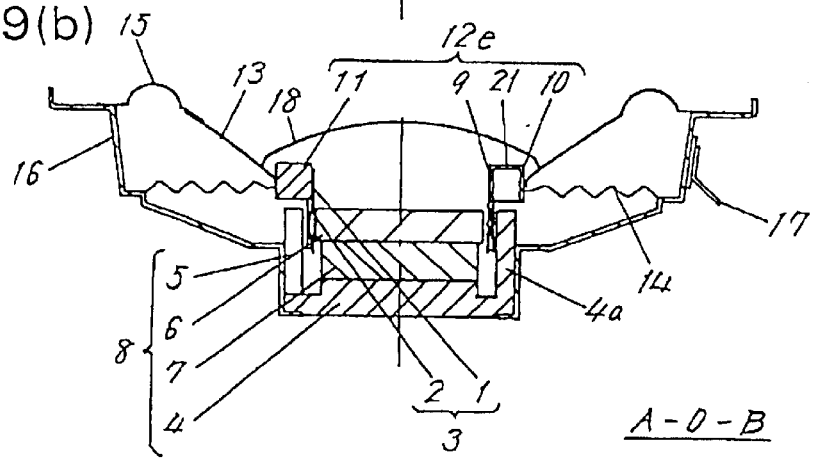
Figure 20A:
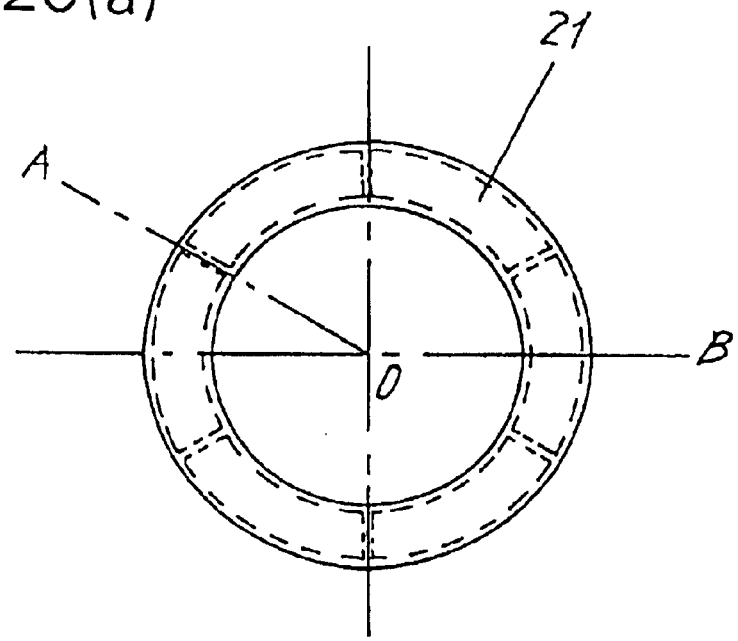
FIG. 20(*a*) is a top view of a double cylinder of the speaker.
Figure 20B:
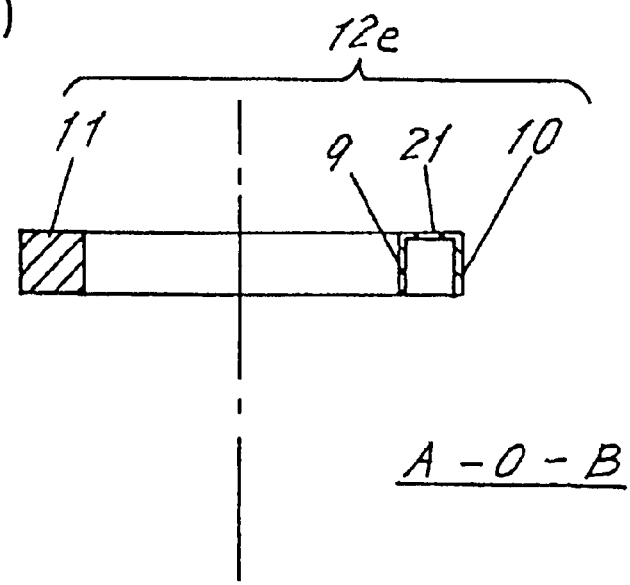

A speaker in accordance with a ninth exemplary embodiment of the present invention is described referring to FIGS. 19(*a*) and 19(*b*), and FIGS. 20(*a*) and 20(*b*).

The difference from the first embodiment is that, as shown in FIGS. 20(*a*) and (*b*), a speaker in the present embodiment uses a double cylinder 12*e*, which is provided with a reinforcement plate 21 disposed on the upper ends of the first cylinder 9, the second cylinder 10 and the joint 11. The reinforcement plate 21 is positioned above the upper end of the outer circumference 4*a* of yoke 4 with an amplitude margin. Therefore, the upper ends of the cylinder 9, the cylinder 10 and the joint 11 are located with the amplitude margin.

The reinforcement plate 21 improves rigidity of the double cylinder 12*e*. Thus, the driving force generated in the voice coil 3 is conveyed surely to the diaphragm 13 through the entire body of the double cylinder 12*e*. This increases the threshold frequency in high frequency range sound reproduction. Besides the improvement in rigidity, the reinforcement plate 21 contributes to making the formation of the double cylinder 12*e* easier.

Although the above description has been made based on the speaker in the first embodiment, the structure in the present embodiment may be introduced to the double cylinders in the foregoing sixth through eighth embodiments to yield the same advantage.

Tenth Embodiment

Figure 21A:
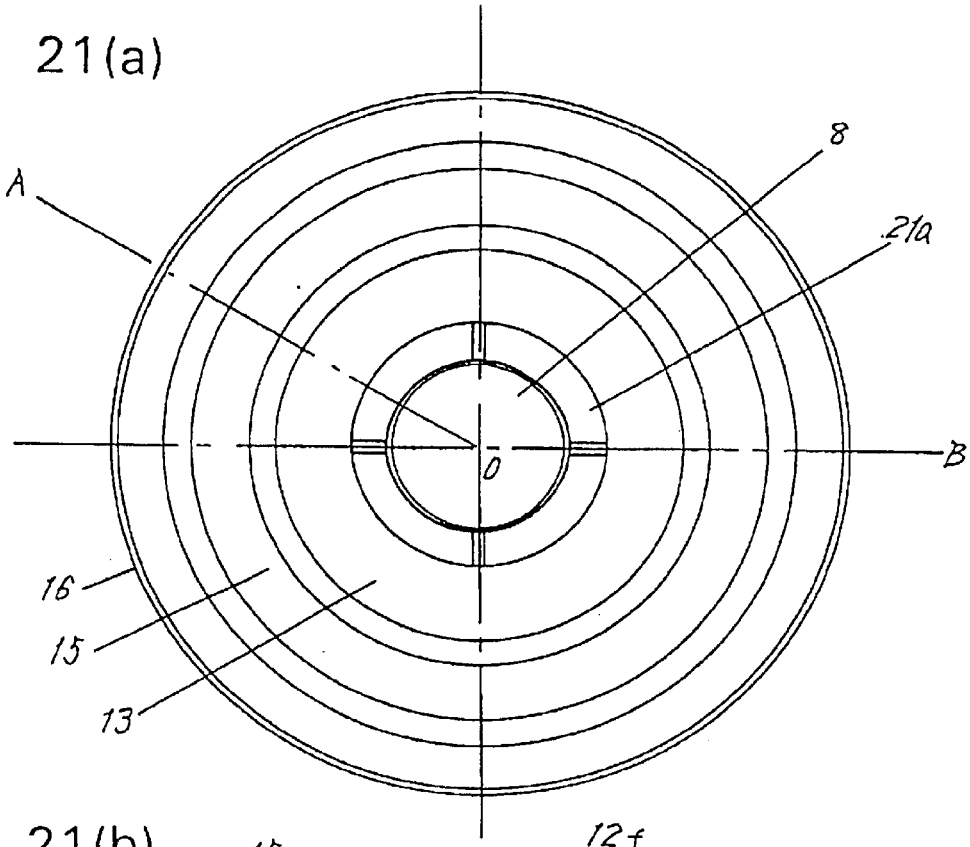
FIG. 21(*a*) is a top view of a speaker in a tenth exemplary embodiment of the present invention.
Figure 21B:
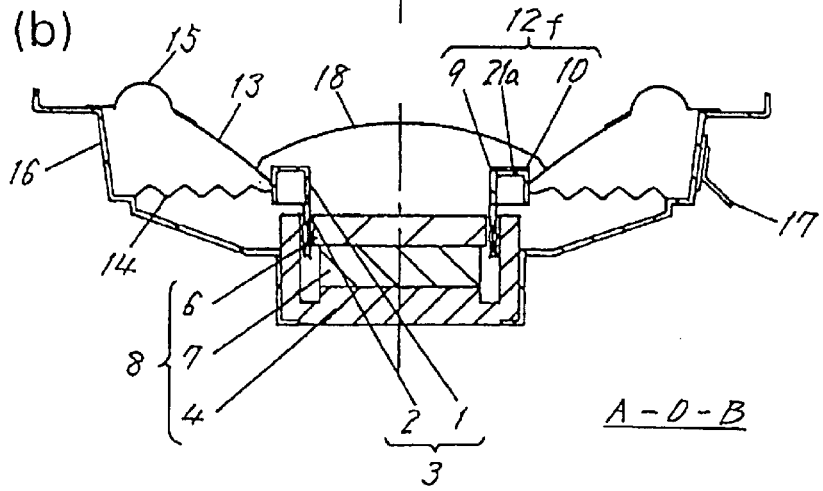
Figure 22A:
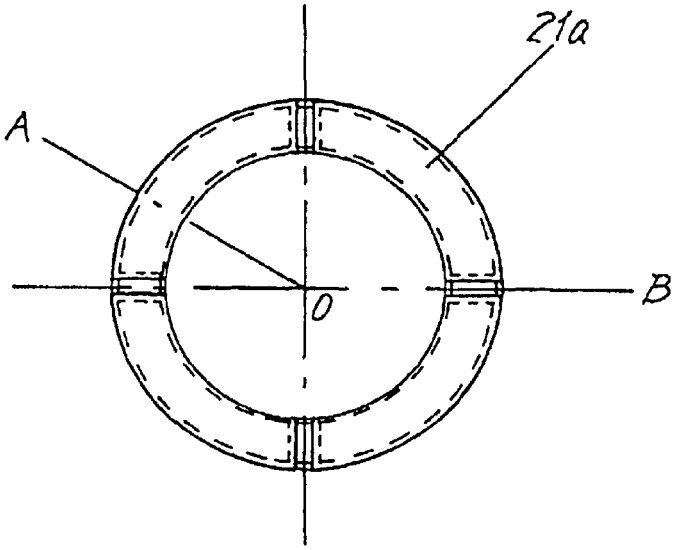
FIG. 22(*a*) is a top view of a double cylinder of the speaker.
Figure 22B:
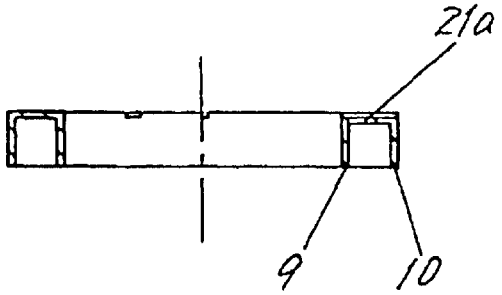

A speaker in accordance with a tenth exemplary embodiment of the present invention is described referring to FIGS. 21(*a*) and 21(*b*), and FIGS. 22(*a*) and 22(*b*).

As compared with the speaker in the ninth embodiment, a double cylinder 12*f* in the present embodiment is formed with a reinforcement plate 21*a* having a recess in the cross sectional shape between the two joints 11. The recessed cross sectional shape of reinforcement plate 21*a* contributes to increase a three-dimensional strength of double cylinder 12*f*. Thus, the double cylinder 12*f* has an increased rigidity as compared with that in the ninth embodiment. Furthermore, the recessed shape provided in an area between the joints 11, which are inserted into the slit 5, does not increase the length in the amplitude direction of double cylinder 12*f*. Still further, a lead wire coming upward from the voice coil 3 may be disposed along the recessed surface of the reinforcement plate 21*a*. By so doing, the effort for making the profile of a speaker more flat is not disturbed by a lead wire, and the assembly operation becomes easier.

The cross sectional shape of the recess in the reinforcement plate 21*a* may be a rectangle, a half circle, a U-shape, a V-shape or any other contours.

Eleventh Embodiment

Figure 23A:
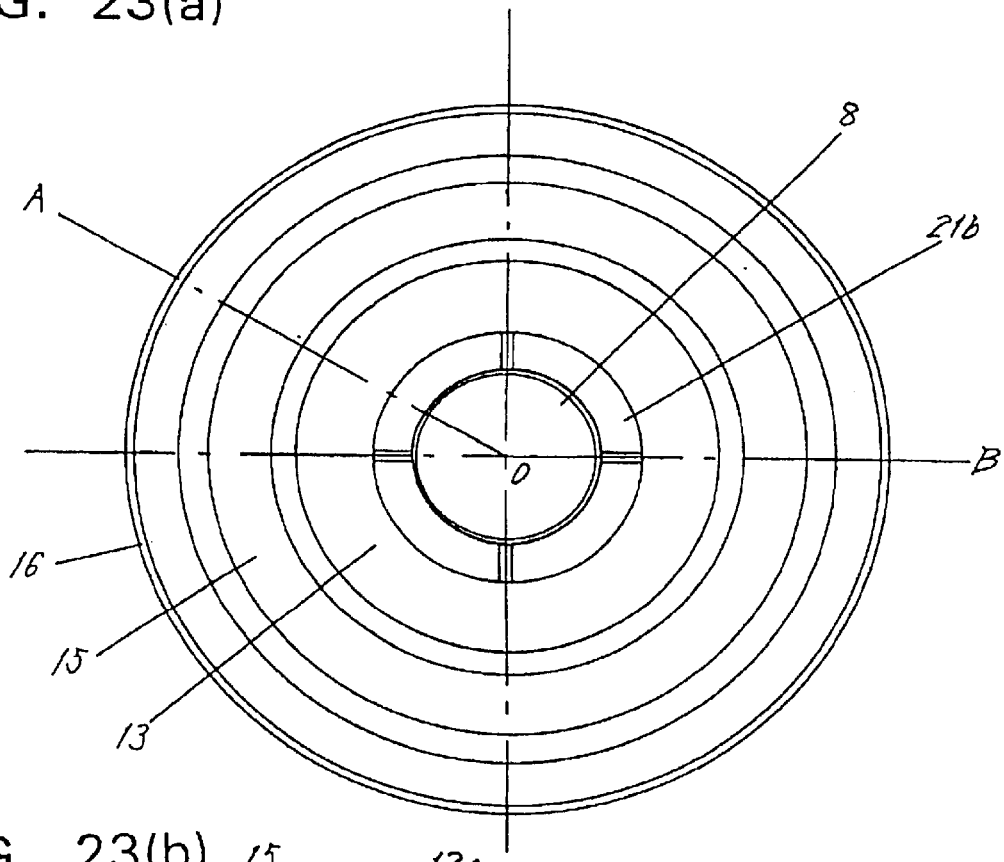
FIG. 23(*a*) is a top view of a speaker in an eleventh exemplary embodiment of the present invention.
Figure 23B:
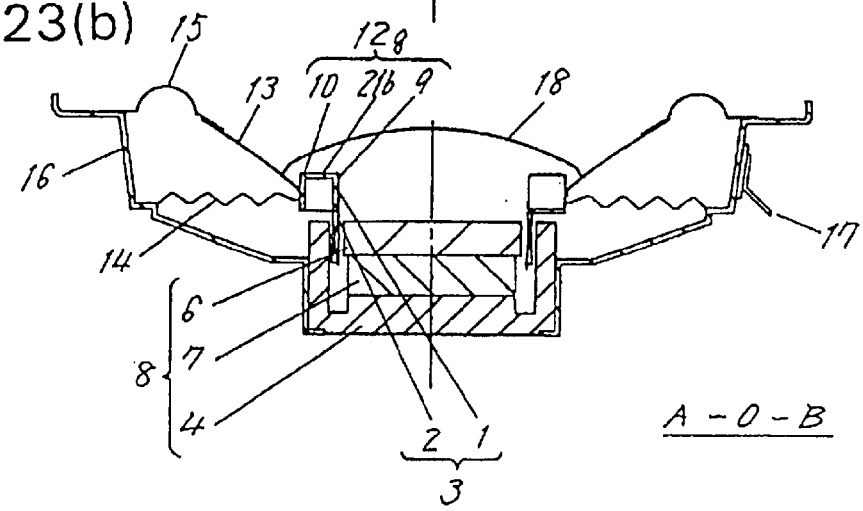
Figure 24A:
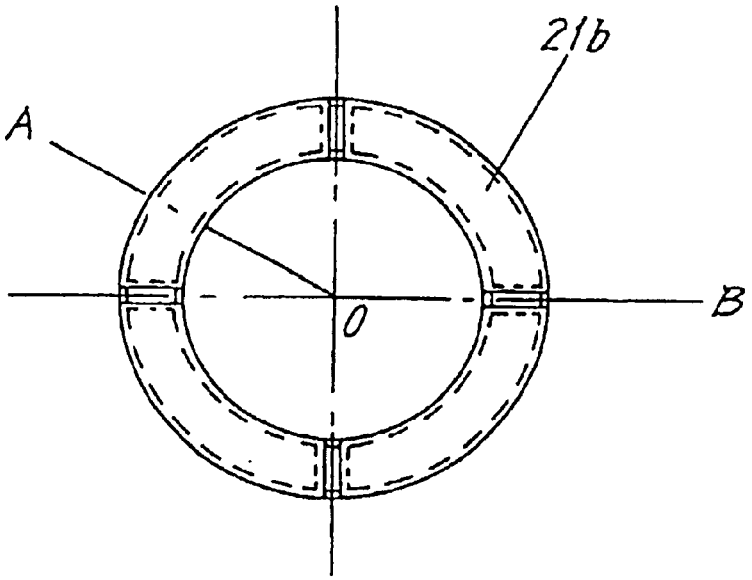
FIG. 24(*a*) is a top view of a double cylinder of the speaker.
Figure 24B:
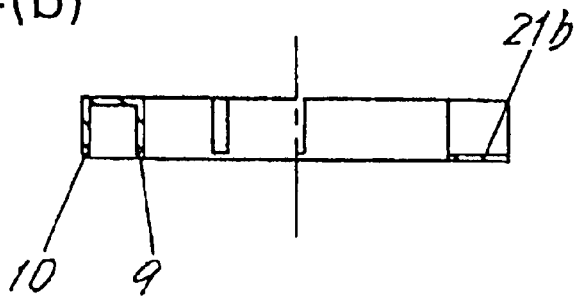

A speaker in accordance with an eleventh exemplary embodiment is described referring to FIGS. 23(*a*) and 23(*b*), and FIGS. 24(*a*) and 24(*b*).

As compared with the speaker in the tenth embodiment, a double cylinder 12*g* in the present embodiment is formed with a reinforcement plate 21*b* with the joints 11 integrated with side surfaces of the recess. The integration of the side surfaces and the joints 11 simplifies the whole structure of double cylinder 12*g*. The double cylinder 12*g* can be formed so that the entire portions have substantially the same wall thickness. As a result, a process for manufacturing the double cylinder 12*g* becomes quite easy. For example, it can be provided by press-forming a nonmagnetic metal sheet.

Twelfth Embodiment

Figure 25A:
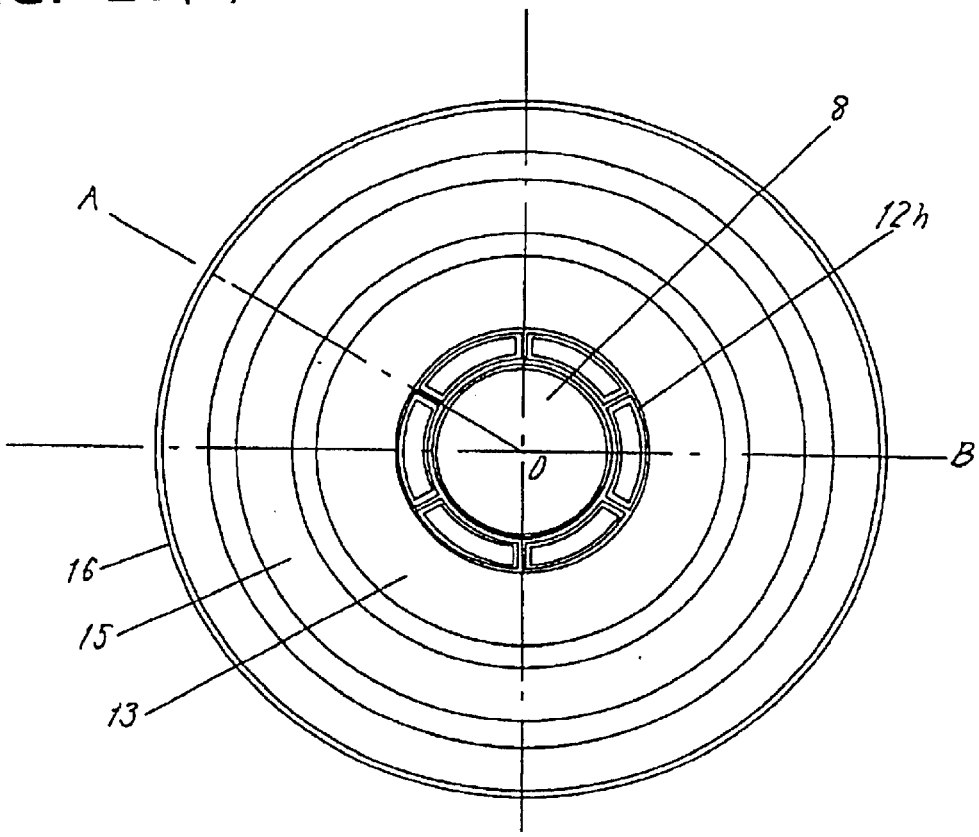
FIG. 25(*a*) is a top view of a speaker in a twelfth exemplary embodiment of the present invention.
Figure 25B:
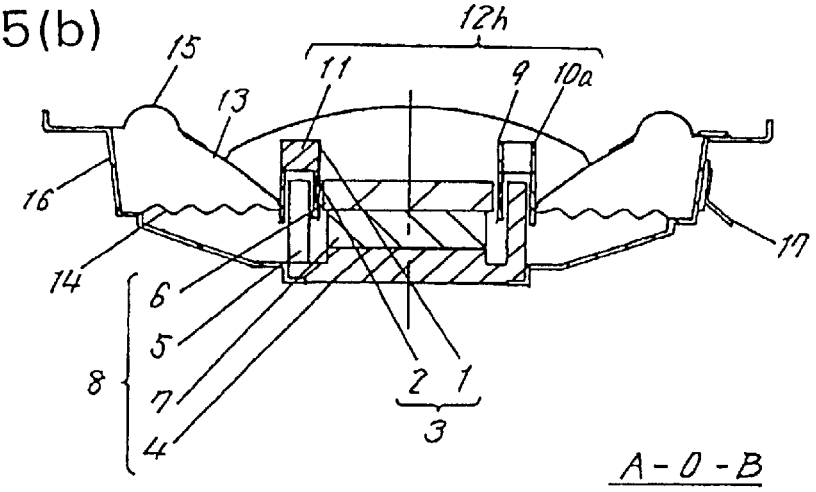
Figure 26A:
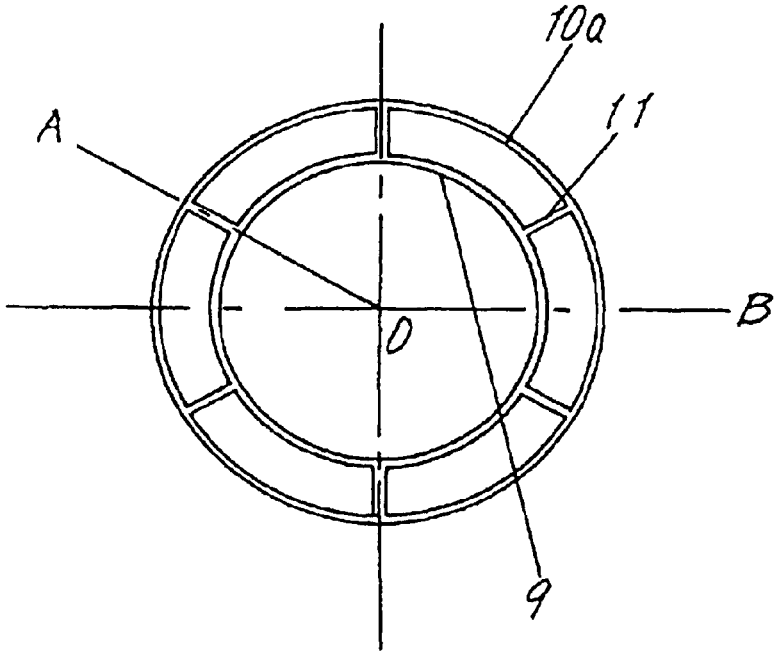
FIG. 26(*a*) is a top view of a double cylinder of the speaker.
Figure 26B:
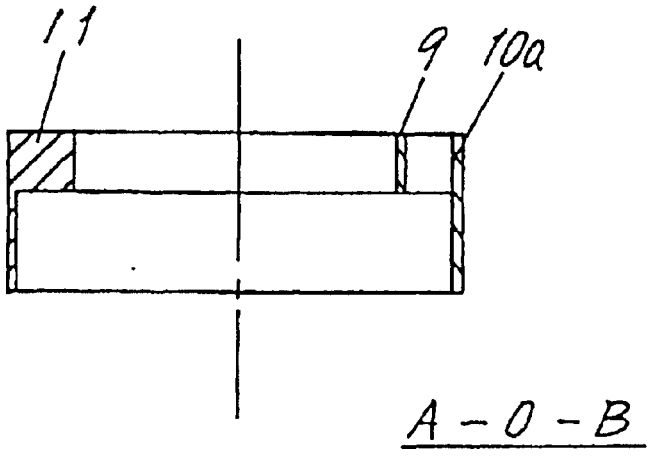

A speaker in accordance with a twelfth exemplary embodiment is described referring to FIGS. 25(*a*) and 25(*b*), and FIGS. 26(*a*) and 26(*b*).

The difference with the speaker in the first embodiment is that, as shown in FIG. 26(*b*), the length of a second cylinder 10*a* of a double cylinder 12*h* in the direction of vibration is longer than that of the joint 11 and the first cylinder 9. The greater length of cylinder 10*a* relative to the joint 11 and the cylinder 9 provides the damper 14 and the diaphragm 13, which are both fixed to the cylinder 10*a*, with greater freedom in the arrangements for their placements. With the above configuration, the damper 14 can be connected to the second cylinder 10*a* at a position lower than the upper surface of magnetic circuit 8, which facilitates making the profile of a speaker more flat. Furthermore, the distance between the outer circumference of the edge 15, or the fixed end of speaker support system, and the outer circumference of the damper 14 is increased as compared to that in the first embodiment, which contributes to providing a higher stability during large amplitude.

Furthermore, since the diaphragm 13 can be connected to the second cylinder 10*a* at a lower extended point, the height of diaphragm 13 can be increased. This increases the strength in the amplitude direction of diaphragm 13 without increasing the thickness of diaphragm 13 and leads to an increased threshold frequency in the reproduction of high frequency range sounds.

The structure of the double cylinder 12*h* in the present embodiment can be introduced in each of the foregoing embodiments to yield the same advantage.

Thirteenth Embodiment

Figure 27A:
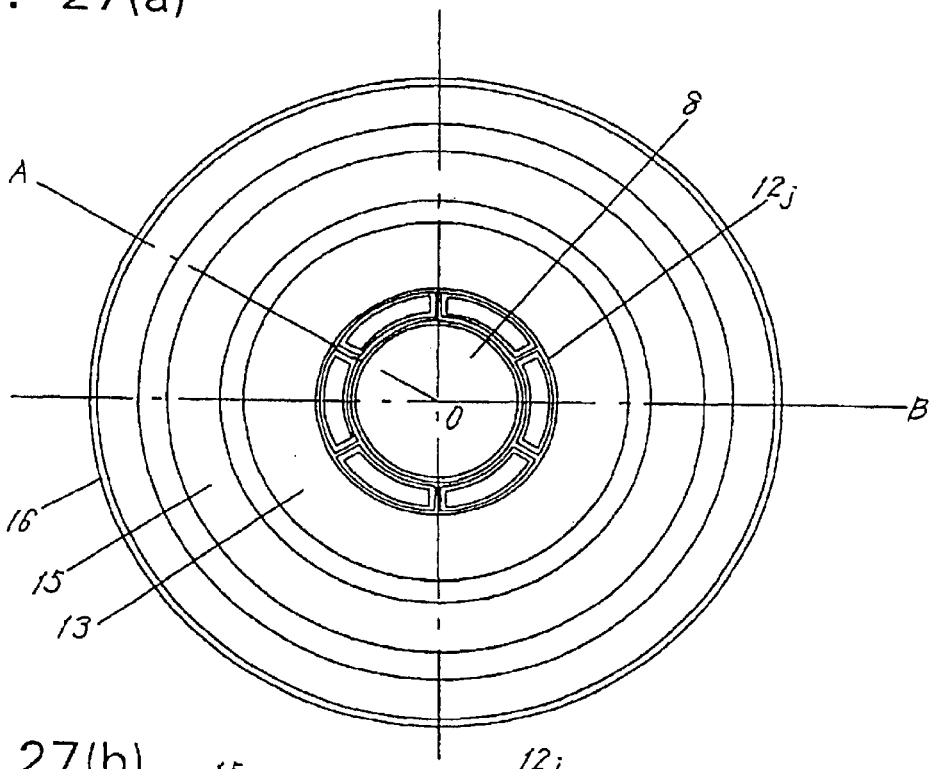
FIG. 27(*a*) is a top view of a speaker in a thirteenth exemplary embodiment of the present invention.
Figure 27B:
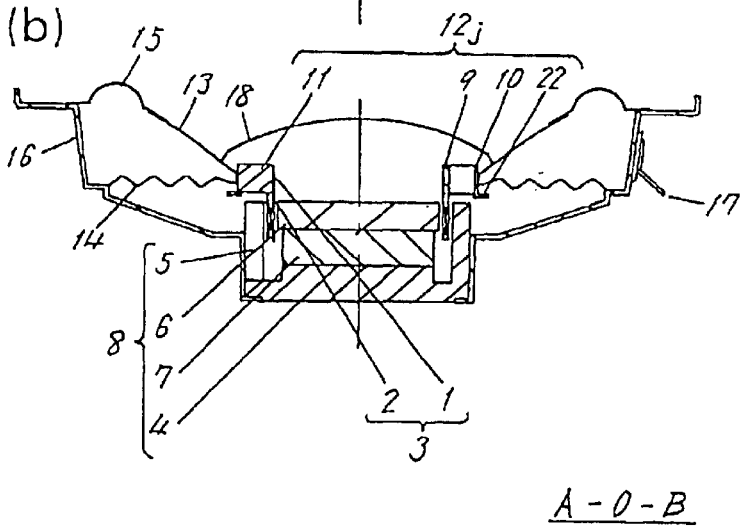
Figure 28A:
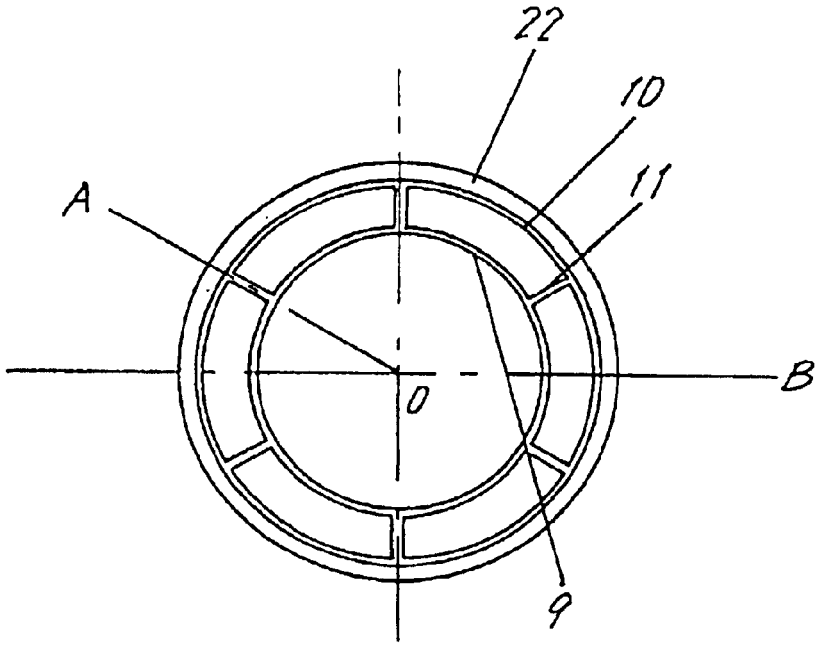
FIG. 28(*a*) is a top view of a double cylinder of the speaker.
Figure 28B:
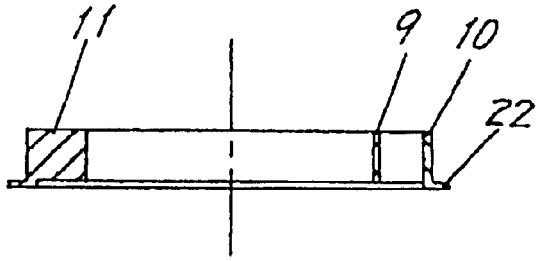

A speaker in accordance with a thirteenth exemplary embodiment is described referring to FIGS. 27(*a*) and 27(*b*), and FIGS. 28(*a*) and 28(*b*).

The difference with a speaker in the first embodiment is that, as shown in FIG. 28(*b*), a double cylinder 12*j* in the present embodiment comprises a second cylinder 10 having at the bottom a reinforcement portion 22 protruding outward. The reinforcement portion 22 at the lower end of the cylinder 10 contributes to increase the strength in a radial direction of the cylinder 10. Process of manufacturing becomes easy when the reinforcement portion 22 is provided by bending the bottom part of the second cylinder 10 outward. The structure of the present embodiment can be introduced to each of the foregoing embodiments to yield the same advantage.

Although not illustrated in the drawings, in the present embodiment, the double cylinder 12*j* may be manufactured with an aluminum alloy or a similar nonmagnetic material having a high thermal conductivity, instead of using insulating materials such as plastic materials, with an insulation layer formed on the upper surface of the joint 11 and the outer circumference of the cylinder 10. This enhances dissipation of the heat generated at the voice coil 3, and increases a heat withstanding property, while insuring electrical insulation for the lead wire from voice coil 3.

The above-described insulation layer may be formed by, for example, adhering a craft paper, or a material of the bobbin. This structure increases an adhesive strength among the diaphragm 13, the damper 14 and the double cylinder 12*j*.

The example in the present embodiment can be introduced to each of the foregoing embodiments for the same advantage.

Fourteenth Embodiment

Figure 29:
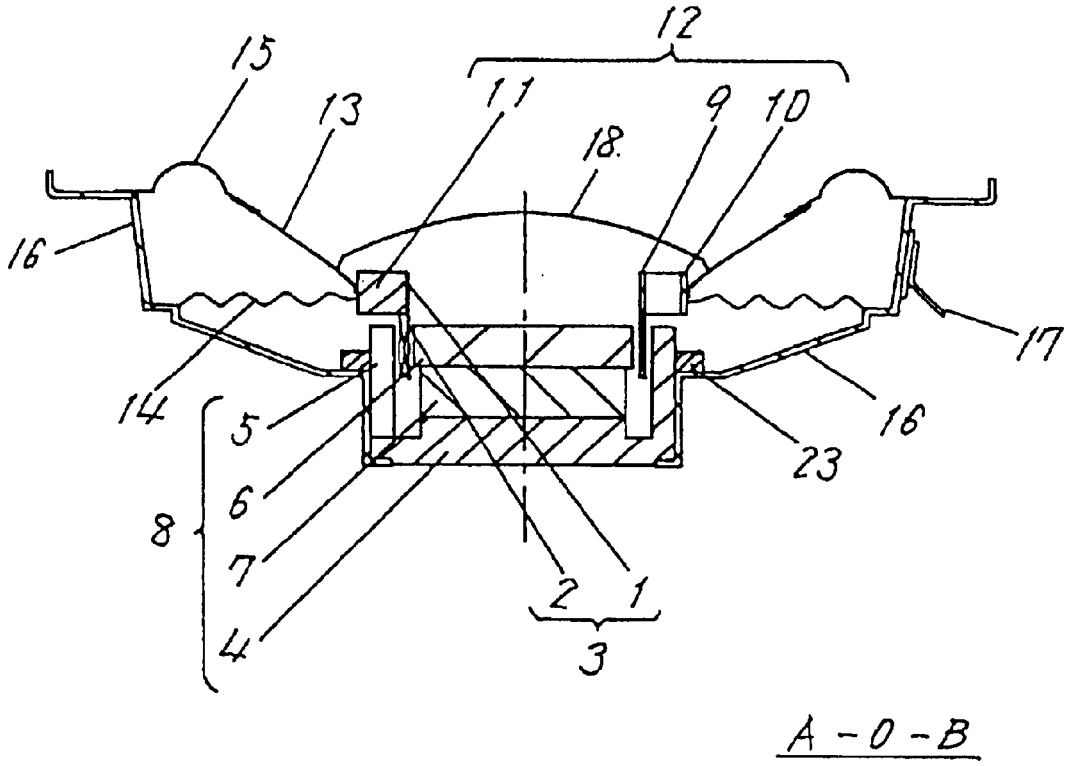
FIG. 29 is a top view of a cross sectional view of a speaker in a fourteenth exemplary embodiment of the present invention.

A speaker in accordance with a fourteenth exemplary embodiment of the present invention is described referring to FIG. 29.

The difference with the speaker in the first embodiment is in a buffer member 23 provided on the frame 16 at a place opposing the second cylinder 10 in the amplitude direction. The buffer member 23 prevents the diaphragm 13 from making an excess amount of amplitude, providing a mechanical protection to the damper 14 and the edge 15. It also contributes to prevent a generation of abnormal sounds generated by a collision of a bottom end of the cylinder 10 with the frame 16.

Although the above description has been based on a buffer member 23 disposed on the frame 16, it may be disposed instead on the bottom end of the cylinder 10. Alternatively, the buffer member 23 may be provided on both the frame 16 and the second cylinder 10. The buffer member 23 may be disposed either in a cylindrical shape, or in a partial shape.

The above-described structure in the present embodiment can be introduced to each of the foregoing embodiments to yield the same advantage.

Fifteenth Embodiment

Figure 30A:
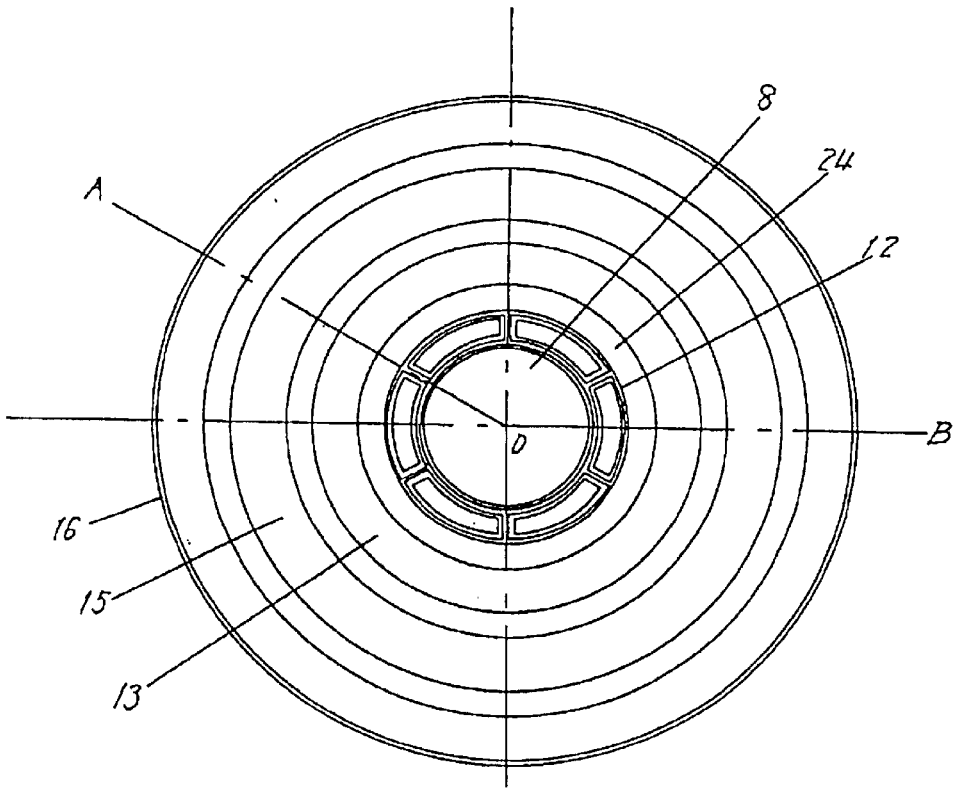
FIG. 30(*a*) is a top view of a speaker in a fifteenth exemplary embodiment of the present invention.
Figure 30B:
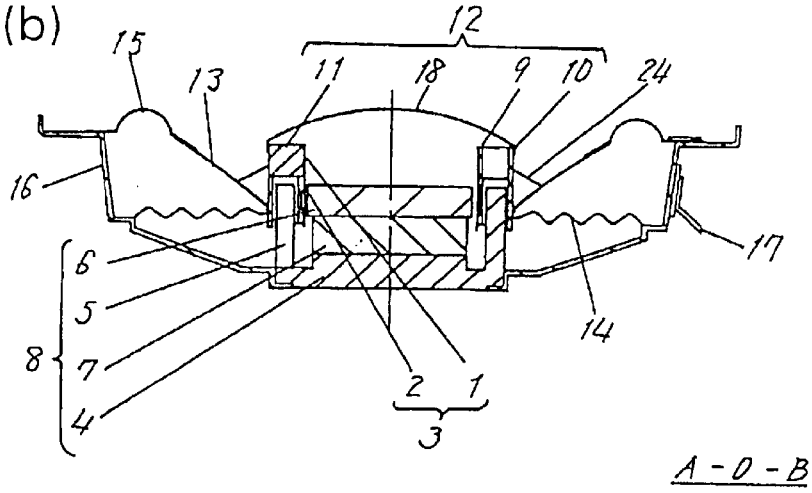

A speaker in accordance with a fifteenth exemplary embodiment of the present invention is described referring to FIGS. 30(*a*) and 30(*b*).

As shown in FIG. 30(*b*), a speaker in the present embodiment is similar to the speaker shown in the twelfth embodiment, but is further provided with a reinforcement piece 24 connecting the diaphragm 13 at a half way point with the outer circumference of double cylinder 12. A dust cap 18 is also attached on the double cylinder 12. The reinforcement piece 24 enhances the strength of diaphragm 13 in the amplitude direction. The dust cap 18 attached on the double cylinder 12 also improves the disturbance in frequency characteristics due to a reflection or a diffraction caused by a vertical portion of the second cylinder 10 higher than a place where the reinforcement piece 24 and the diaphragm 13 are connected.

Although the reinforcement piece 24 is illustrated in the shape of a thin ring form in FIG. 30(*a*), the outer circumference may have a star shape, or the entire reinforcement piece may have a rib shape.

The above-described structure in the present embodiment can be introduced to each of the foregoing embodiments to yield the same advantage.

The reinforcement piece 24 may be provided using a material of relatively great mass. In such a case, the reinforcement piece 24 works as a weight addition member. In order to improve the efficiency of heavy bass sound reproduction, it is a normal practice to increase the weight of the vibrating system. Accordingly, most of the speakers for heavy bass reproduction are provided with a weight adding member. The reinforcement piece 24 connecting the diaphragm 13 at a half way point with the outer circumference of the double cylinder 12 can be a weight increasing member, besides its function of increasing the strength of diaphragm 13 in the amplitude direction.

A lead wire from the voice coil 3, after it is taken out along the upper surface of the double cylinder 12, may be guided along the reinforcement piece 24. By so doing, the lead wire is not bent sharply at the point where the outer circumference of cylinder 10 is connected with the diaphragm 13, and the lead wire is well protected from a possible breakage, and the assembly operation becomes easier.

Although in the foregoing first through fifteenth embodiments, the number of the slits 5 in the outer circumference 4*a* of yoke 4 are 6 or 4, and the number of the joints 11 are 6 or 8, they are not limited to these numbers. The number may be either an odd number or an even number.

Although the descriptions of the magnetic circuit 8, the double cylinder 12, and the diaphragm 13, etc. have been based on an assumption that these items have a round form, they may have an oval, a square or other forms.

Figure 38:
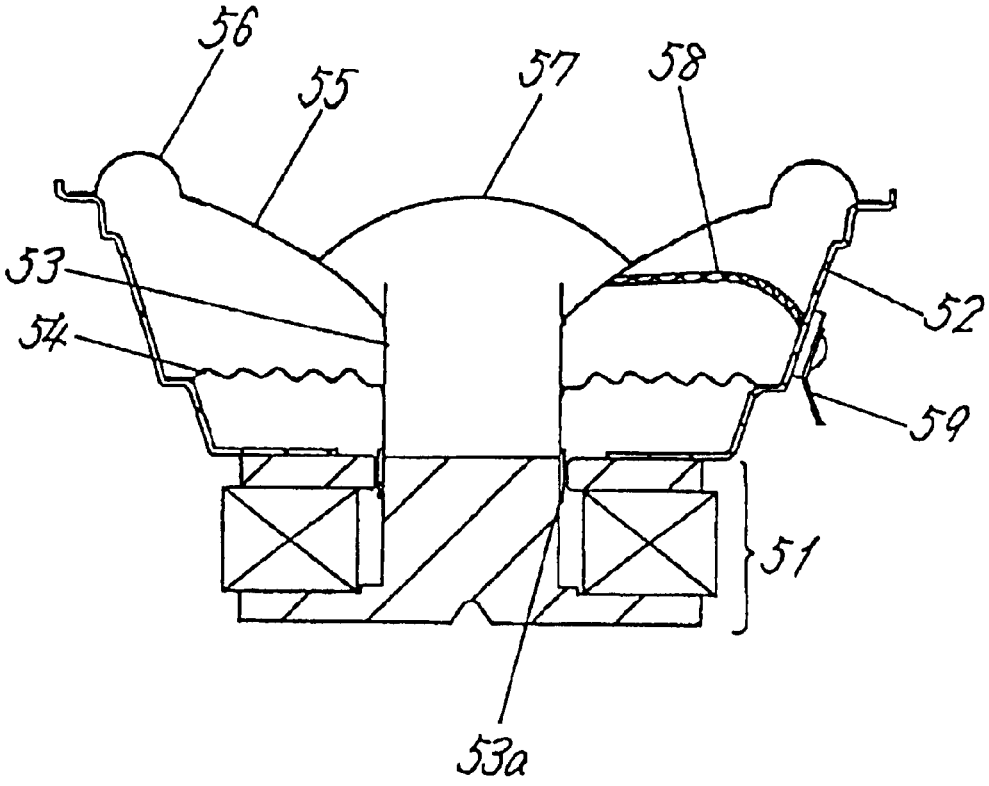
FIG. 38 PRIOR ART
FIG. 38 is a cross sectional view of a prior art speaker.
Figure 39:
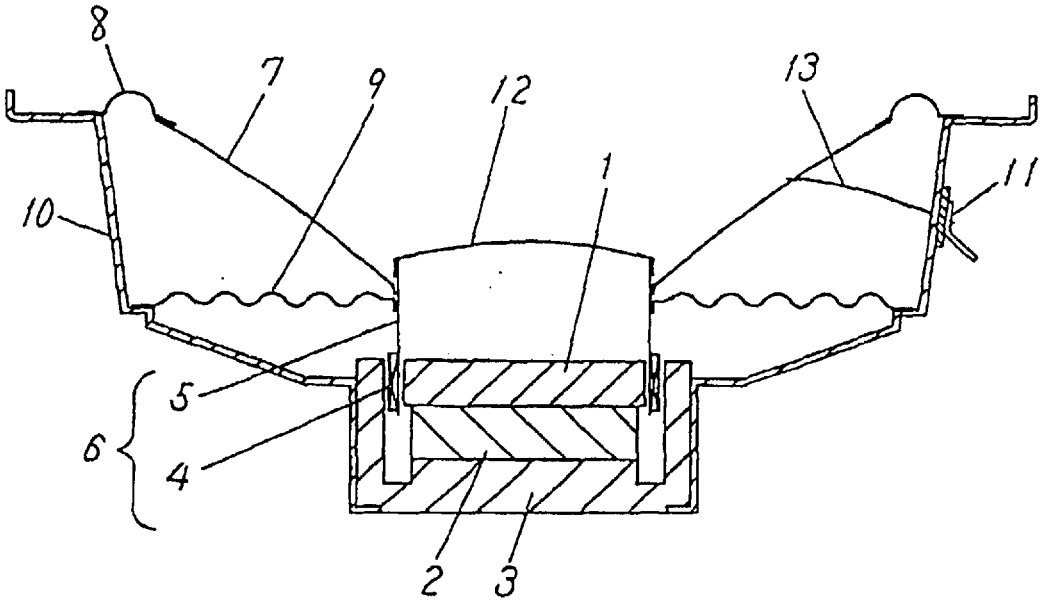
FIG. 39 PRIOR ART
FIG. 39 is a cross sectional view of another prior art speaker.

Although description of the magnetic circuit 8 has been based on a configuration in which there is one disc magnet 7 and one magnetic gap, it is not limited to what is described above. Descriptions in the foregoing embodiments have been based mainly on an inner magnet type speaker, because the present invention reveals its significance in the inner magnet type speakers, among other types. However, the concept of the present invention also works effectively in the outer magnet type speakers by providing necessary adaptations; for example in the structure of FIG. 38, by forming an upper plate 44 with a thin sheet and forming a slit for a magnetic gap by bending it upward.

The shape of dust cap 18 and the location of connection described above is just exemplary. A dust cap 18 may take the form of a flat sheet shape, for example, and may be attached on the double cylinder 12.

As an alternative, instead of providing a dust cap 18, a tweeter may be attached on the center pole 6 to complete a flat-profile coaxial speaker.

Sixteenth Embodiment

Figure 31:
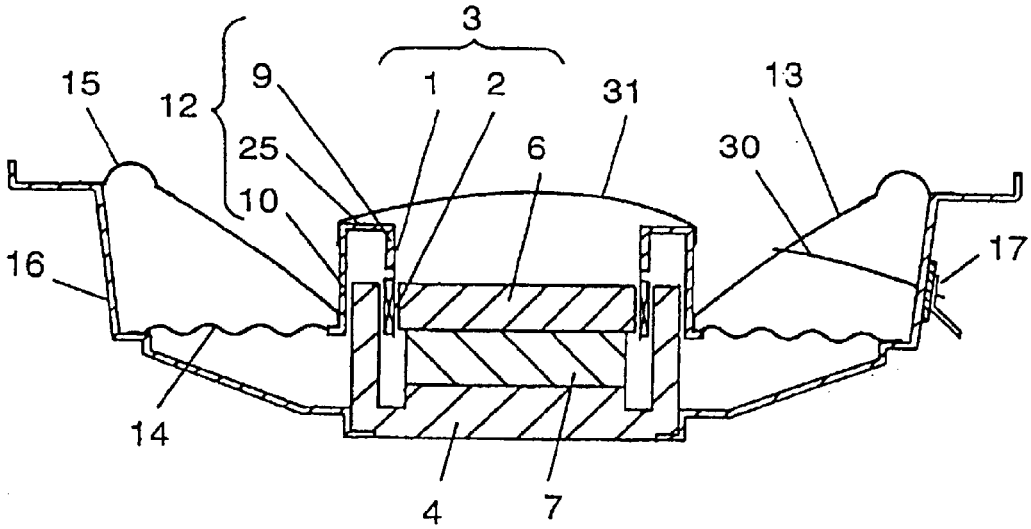
FIG. 31 is a cross sectional view of a speaker in a sixteenth exemplary embodiment of the present invention.

A speaker in accordance with a sixteenth exemplary embodiment of the present invention is described referring to FIG. 31. FIG. 31 shows a cross sectional view of a speaker in the present embodiment. The difference from the first embodiment is that the first cylinder 9 and the second cylinder 10 are connected together by a first ring 25, instead of the joint 11 in the first embodiment. The above configuration renders the slits formed in the yoke 4 of the first embodiment unnecessary. As a result, the outer dimensions of the yoke can be made smaller than those in the first embodiment, and dimensions of the double cylinder can be reduced accordingly to make the weight of the vibration system lighter.

The bottom end of the second cylinder 10 is bent outward to provide a reinforcement portion. The inner circumference of damper 14 is bent upward, and the lower surface is fixed on the reinforcement portion. Thus, an increased connecting area ensures a stronger connection.

Furthermore, the damper 14 is sandwiched by the diaphragm 13 and the reinforcement portion. Thus, the connecting strength of the damper 14 to the second cylinder 10 is increased sufficiently to obtain an increased reliability. The damper 14 bent upward at the inner circumference makes an operation of inserting the damper from the above easier during assembly of a speaker.

Seventeenth Embodiment

Figure 32A:
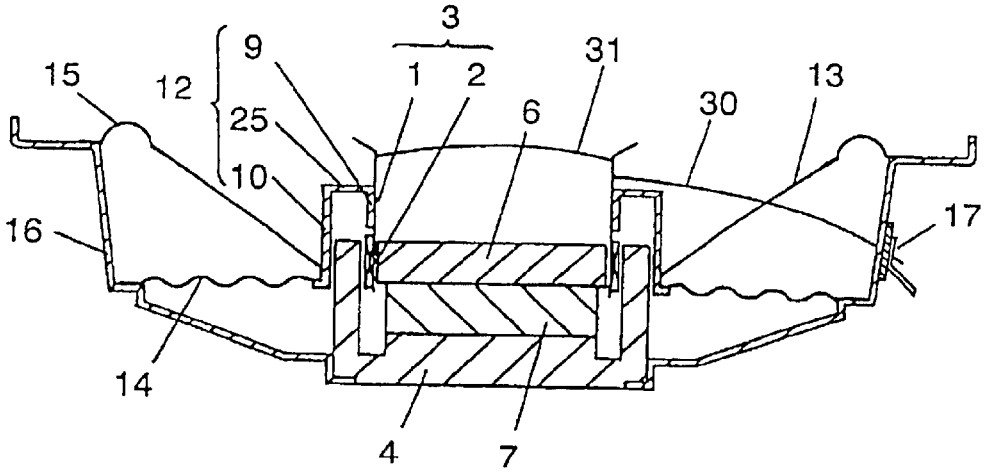
FIG. 32(*a*) is a cross sectional view of a speaker in a seventeenth exemplary embodiment of the present invention.
Figure 32B:
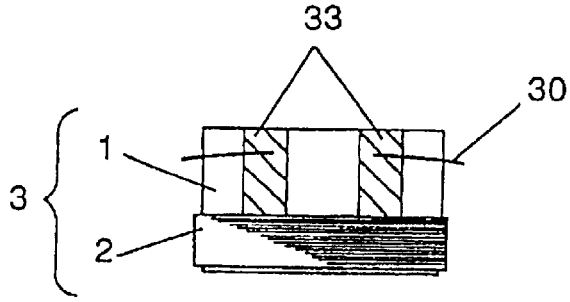

A speaker in accordance with a seventeenth exemplary embodiment of the present invention is described referring to FIGS. 32(*a*) and 32(*b*).

The differences from the sixteenth embodiment are that the upper end of bobbin 1 is extended higher than the top end of the double cylinder 12, namely, above the first cylinder 9, and metal foils 31 exposed on the bobbin 1 at a place above the coupled portion are connected at the outer surface with flexible wires 30. Another end of the flexible wires are connected to a terminal 17. The lead wires in the present embodiment consist of the flexible wires 30 and the metal foils 31. The metal foil 31 is connected on the bobbin 1 with coil 2, and the flexible wire 30 is connected at one end with the outer surface of the metal foil 31, which is exposed on the outer surface of the bobbin 1 in an area between the upper end of the bobbin 1 and the upper end of the first cylinder 9. Another end of the flexible wire 30 penetrates through the diaphragm 13 and is connected to the terminal 17.

In the present embodiment, the lead wire which used to be led along the double cylinder 12 is eliminated to ease an assembly operation, and the lead wire will hardly be affected by a stress caused during the assembly operation. Furthermore, the reliability against a possible broken lead wire is improved, since a strong flexible wire is connected on the surface of bobbin 1.

When a dust cap 18 is attached to the bobbin 1 at the inner circumference, the dust cap 18 does not appear on the outer surface of the bobbin 1. Thus, an exposed area of bobbin 1 needed for the connection of metal foil 31 with the flexible wire 30 can be limited to a minimum. This is also an advantage for making a flat-profile speaker.

The shape and disposition of metal foils 31, as well as a connecting direction of the flexible wires 30 in relation to the metal foils 31, as illustrated in FIGS. 32(*a*) and 32(*b*), are just exemplary. They are not limited to those arrangements illustrated in the drawings. For example, the metal foils 31 shown in FIG. 32(*b*) are placed adjacent to each other, but they may be disposed on the surface of bobbin 1 at respective locations opposing to each other, and the flexible wire 30 may be connected in the vertical direction.

Eighteenth Embodiment

Figure 33:
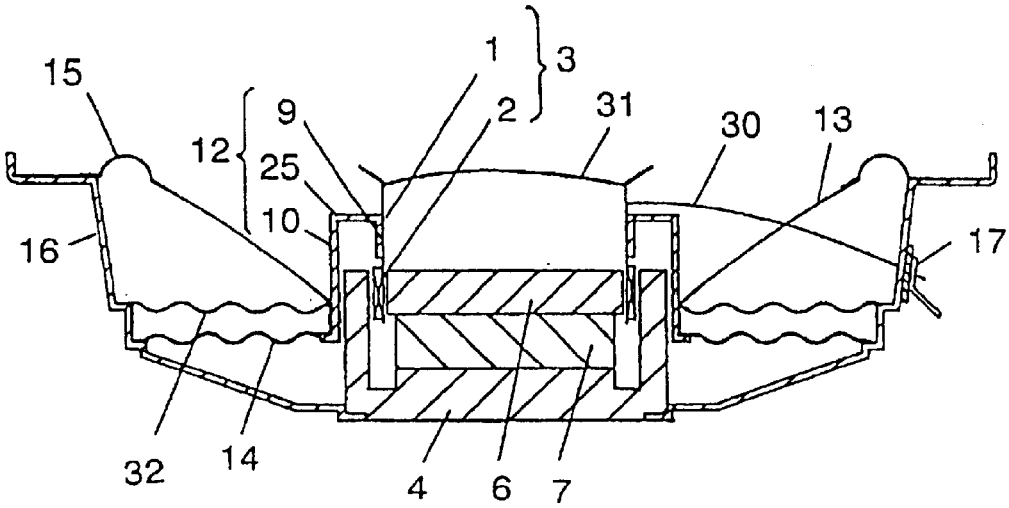
FIG. 33 is a cross sectional view of a speaker in an eighteenth exemplary embodiment of the present invention.

A speaker in accordance with an eighteenth exemplary embodiment of the present invention is described referring to FIG. 33.

The speaker in the present embodiment is provided with a second damper 32. The difference from the seventeenth embodiment is that the inner circumferential part of the second damper 32 is bent downward to be fixed on the outer circumferential surface of second cylinder 16.

In the present embodiment, the second damper 32 and the first damper 14 are disposed symmetrically in an up-and-down direction against the amplitude direction. As a result, the asymmetric component included in radiated sounds that is caused by an up-and-down asymmetry of the amplitude can be reduced. Furthermore, during an assembly operation of the speaker, adhesive material can be applied easily from the above to the place where the second damper 32 and the double cylinder 12 are connected. The bent end of the inner circumference of the second damper 32 can be fixed to the upper end of the bent end of the inner circumference of the first damper 14. Thus, the second damper 32 is provided at the inner circumference with a sufficient connecting area to ensure a sufficiently high connecting strength, which leads to a high reliability of the speaker.

Nineteenth Embodiment

Figure 34:
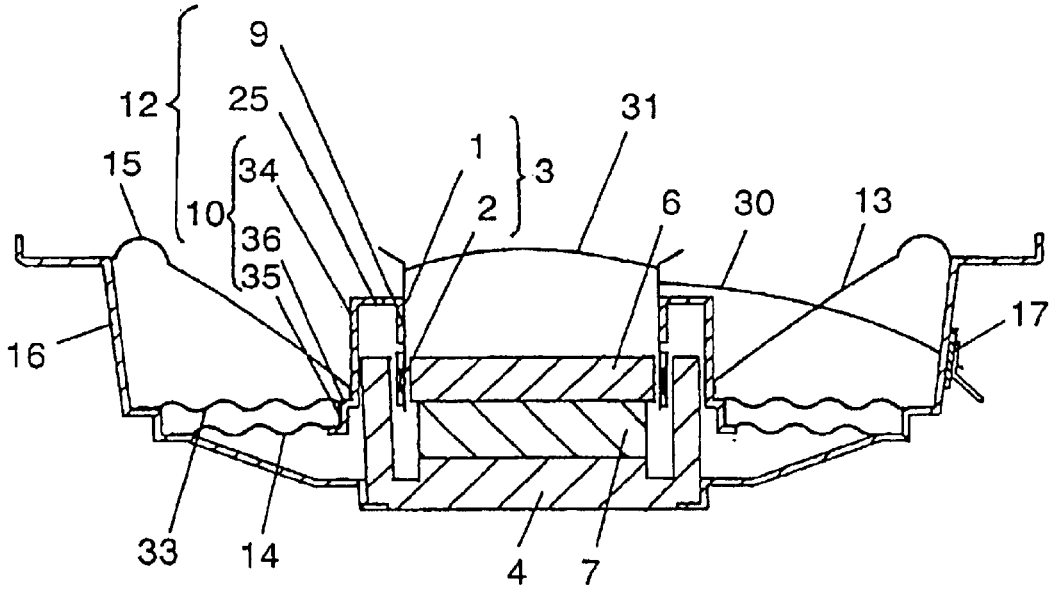
FIG. 34 is a cross sectional view of a speaker in a nineteenth exemplary embodiment of the present invention.

A speaker in accordance with a nineteenth exemplary embodiment of the present invention is described referring to FIG. 34.

The difference from the sixteenth through eighteenth embodiments is that a second cylinder 10 in the present embodiment is formed of a third cylinder 34 and a fourth cylinder 35, each of the cylinders having a different diameter. The third cylinder 34 and the fourth cylinder 35 are connected by a second ring 36; the third cylinder 34 being located higher than the fourth cylinder 35, and the fourth cylinder 35 having a diameter greater than that of the third cylinder 34.

The inner circumference of diaphragm 13 is fixed to the outer circumference of third cylinder 34, the inner circumference of second damper 32 is bent upward to be fixed to the outer circumference of third cylinder 34, the inner circumference of second damper 32 is fixed at the lower surface on the upper surface of the second ring 36, the inner circumference of first damper 14 is bent upward to be fixed to the outer circumference of fourth cylinder 35, and the inner circumferential part of first damper 14 is fixed at the lower surface on the upper surface of a reinforcement portion formed by bending the bottom end of fourth cylinder 35 towards the direction of the outer diameter.

The first damper 14 and the second damper 32 with their inner circumferential parts bent upward for making areas of connection with the double cylinder 12 larger facilitate an easy insertion and connection of the dampers with the double cylinder 12 during assembly of a speaker. The increased connecting areas of the first damper 14 and the second damper 32 provides sufficient adhesion area and adhesive strength with the double cylinder 12. This improves the reliability of the speaker, like in the foregoing embodiments. Furthermore, the stepped structure provided in the outer circumference of the double cylinder 12, or the second cylinder 10, enhances the mechanical strength in the radial direction of the double cylinder 12 itself. Thus, the structure in the present embodiment is suitable for use in the large-output speakers.

Although a flexible wire 30 in the present embodiment is illustrated in the same arrangement as in the seventeenth embodiment, the flexible wire 30 can be connected in an arrangement like in the sixteenth embodiment, for yielding the same advantage.

Twentieth Embodiment

Figure 35:
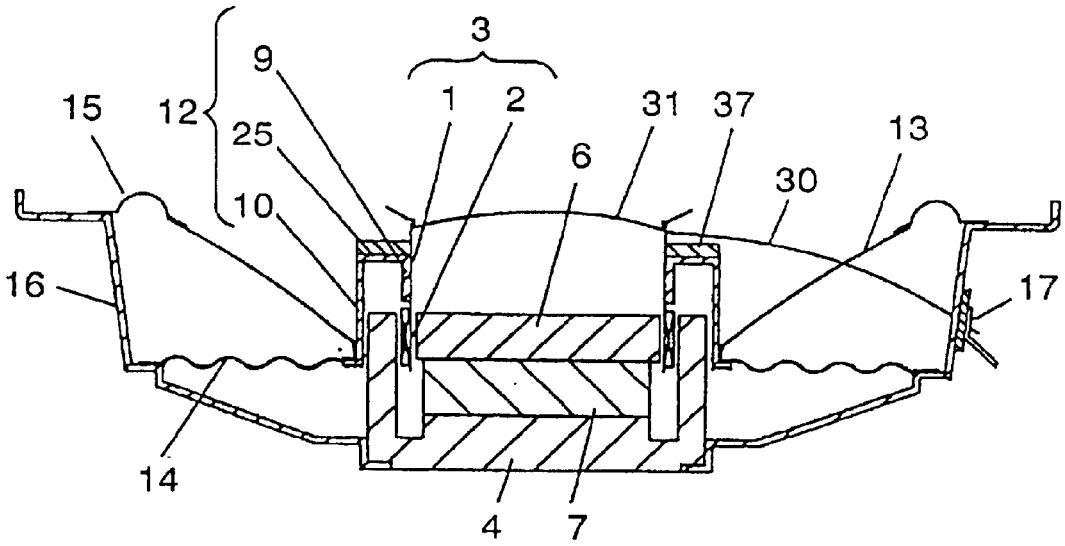
FIG. 35 is a cross sectional view of a speaker in a twentieth exemplary embodiment of the present invention.

A speaker in accordance with a twentieth exemplary embodiment of the present invention is described referring to FIG. 35. The difference from the seventeenth embodiment is that the speaker in the present embodiment is provided with a third ring 37, which is a weight adding member, fixed on the first ring 25. The above-described structure in the present embodiment facilitates reproduction of heavy bass sounds.

As a general principle, a speaker having the greater gross weight in the vibration system, viz., diaphragm 13 plus voice coil 3, reproduces the lower bass sounds. Thus, in a speaker called a subwoofer used exclusively for reproduction of heavy bass sounds, a total weight of the diaphragm 13 and the like portions are intentionally made to be greater. The speaker in the present embodiment is provided with a third ring 37 disposed on the sufficiently rigid double cylinder 12, the ring 37 functioning as a weight. The rigid double cylinder 12 of the present embodiment becomes a practical means for effectively avoiding a possible deformation of the speaker, etc., which might occur by the additional installation of a third ring 37.

If the third ring 37 is manufactured using, for example, a resin material having a great internal loss, it can function as an effective means for suppressing unwanted resonance during driving of a speaker.

Twenty-first Embodiment

Figure 36:
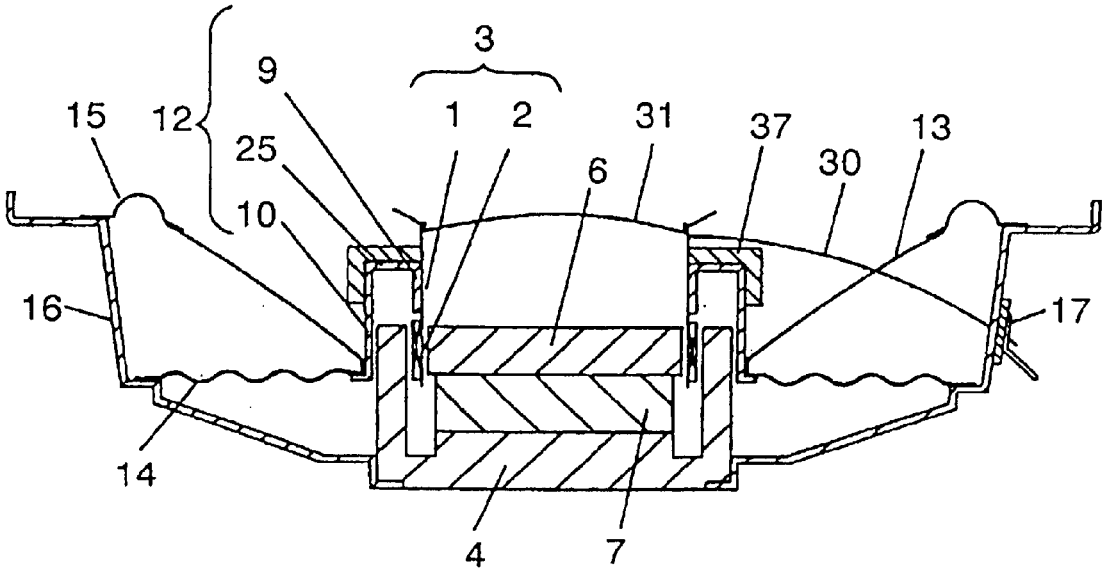
FIG. 36 is a cross sectional view of a speaker in a twenty-first exemplary embodiment of the present invention.

A speaker in accordance with a twenty-first exemplary embodiment of the present invention is described referring to FIG. 36.

The difference from the twentieth embodiment is that the outer circumference of third ring 37 is bent downward to be fixed onto the cylinders in the following manner; the bottom surface of third ring 37 is fixed to the upper surface of cylinder 9, and the inner surface of the bent portion of third ring 37 is fixed to the outer circumference of cylinder 10.

The structure of the present embodiment is advantageous when the speaker is applied to a subwoofer; wherein a weight adding member does not cause an increased overall height of the speaker, and wherein the increased connection area provides a sufficient connecting strength between the double cylinder 12 and the weight adding member.

The same advantage can also be obtained with the speaker in the nineteenth embodiment, by bending the third ring 37 downward to be fixed to the third cylinder 34.

Although the descriptions in the foregoing embodiments have been described on a most commonly-used inner magnet type magnetic circuit, the same advantage can also be obtained in other types of magnetic circuits, for example, a magnetic circuit having a radially-magnetized magnet.

Figure 37:
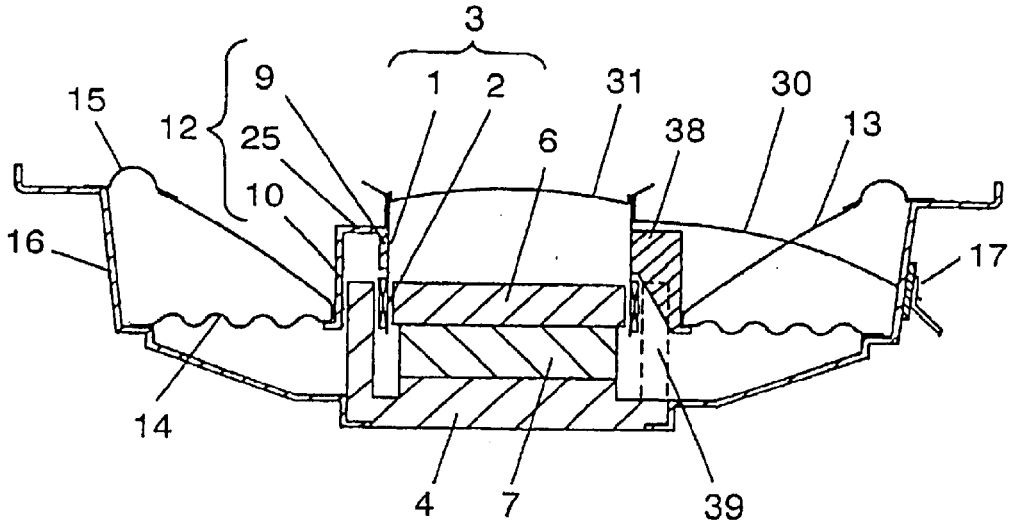
FIG. 37 is a cross sectional view of another example of a speaker in a twenty-first exemplary embodiment of the present invention.

Furthermore, the concept of the present embodiment can be applied into a structure as illustrated in the cross sectional view shown in FIG. 37, where a joint 38 is provided at least between the first cylinder 9 and the second cylinder 10 for forming a double cylinder 12, and a slit 5 is composed so that the joint 38 does not come into contact with the yoke 4 during operation of the speaker.

According to the present invention, a flat-profile speaker that is capable of handling a great amplitude with superior stability can be implemented by shifting the location of damper to be lower than the conventional level, by taking an advantage of a double cylinder structure. The speaker is small and flat while being compatible with a great input power. Furthermore, the speaker provides an increased connecting strength of damper, and a sufficient operational reliability.

What is claimed is:

1. A loudspeaker comprising:

a bobbin;

a coil wound around an outer surface of said bobbin;

a magnetic circuit having a magnetic gap in which said coil is inserted;

a first cylinder coupled at an inner circumferential surface thereof with an outer circumference of said bobbin, wherein a height of a top edge of said first cylinder and a height of said bobbin are substantially the same;

a second cylinder coupled with said first cylinder and disposed around an outer circumference of said magnetic circuit, said second cylinder having a continuous top edge;

a diaphragm and a damper both coupled with an outer circumference of said second cylinder;

an edge coupled with said diaphragm;

a frame to which an outer circumference of said damper and an outer circumference of said edge are fixed; and terminals electrically coupled with said coil and fixed to said frame, wherein the height of the top edge of said first cylinder and a height of the top edge of said second cylinder are substantially the same.

2. The loudspeaker of claim 1, wherein said bobbin is coupled at an outer circumference thereof in an area lower than said coil with the inner circumferential surface of said first cylinder.

3. The loudspeaker of claim 1, wherein a length of said second cylinder is larger than a length of said first cylinder.

4. The loudspeaker of claim 1, wherein said second cylinder is provided at a lower end thereof with a reinforcement portion expanding outward.

5. The loudspeaker of claim 1, further comprising a reinforcement piece operable to connect said second cylinder to said diaphragm.

6. The loudspeaker of claim 5, wherein said reinforcement piece is a weight adding member.

7. The loudspeaker of claim 5, wherein lead wires from said coil are disposed along said reinforcement piece.

8. The loudspeaker of claim 1, wherein a buffer member is provided between a bottom end of said second cylinder and said frame at a location opposing a bottom end of said second cylinder.

9. The loudspeaker of claim 1, wherein an outer circumference of a yoke forming said magnetic circuit is provided with a plurality of slits, wherein said first cylinder and said second cylinder are connected by a plurality of joints disposed in a radial direction, and wherein said plurality of joints are disposed so that said joints can move within said plurality of slits in a direction of vibration without making contact thereto.

10. The loudspeaker of claim 9, wherein two slits, among said plurality of slits, are disposed symmetrically with a center of said terminals as a center of symmetry, and wherein lead wires extending from said voice coil are disposed along said first cylinder or said second cylinder at locations corresponding to said two slits.

11. The loudspeaker of claim 9, wherein an outer circumference distance of said yoke between two adjacent slits, among said plurality of slits, has a same distance as an inner circumference distance of said yoke.

12. The loudspeaker of claim 9, wherein each of said slits is formed so that a bottom end thereof extends halfway to the outer circumference of said yoke.

13. The loudspeaker of claim 9, wherein said first cylinder is provided with a cut.

14. The loudspeaker of claim 9, wherein said first cylinder is provided at a place of connection to at least one of said joints with a bent part.

15. The loudspeaker of claim 9, wherein two of said joints are inserted in one of said slits.

16. The loudspeaker of claim 15, wherein a distance between said two of said joints increases with an increasing distance from a center of said first cylinder.

17. The loudspeaker of claim 9, further comprising a reinforcement plate disposed between an upper end of said first cylinder and an upper end of said second cylinder.

18. The loudspeaker of claim 17, wherein said reinforcement plate is provided with a recess having a cross sectional shape of one a rectangle, a half circle, a U shape and a V shape.

19. The loudspeaker of claim 18, wherein lead wires from said coil are disposed along said recess.

20. The loudspeaker of claim 18, wherein a side surface of said recess is integrated with at least one of said joints.

21. The loudspeaker of claim 18, wherein at least an upper surface of said recess and an outer circumferential surface of said second cylinder are provided with an insulation layer.

22. The loudspeaker of claim 21, wherein the insulation layer provided on said second cylinder is a kraft paper.

23. The loudspeaker of claim 9, wherein at least an outer circumferential surface of said second cylinder is provided with an insulation layer.

24. The loudspeaker of claim 23, wherein the insulation layer provided on said second cylinder is a kraft paper.

25. The loudspeaker of claim 1, wherein upper ends of said first cylinder and said second cylinder are connected by a ring.

26. The loudspeaker of claim 25, further comprising:

a dust cap attached to an inner circumference of said bobbin at a position lower than an upper end of said bobbin;

metal foils provided on said bobbin and connected with said coil; and flexible wires connected at first ends thereof with said metal foils exposed on an outer circumference of said bobbin and in an area between an upper end of said bobbin and the upper end of said first cylinder, wherein said flexible wires penetrate said diaphragm so as to connect at second ends thereof with said terminals.

27. The loudspeaker of claim 25, wherein said damper and said diaphragm are fixed to an outer circumferential surface of said second cylinder such that an upper end of an inner circumferential portion of said damper bent upward makes contact with a lower face of an inner circumference of said diaphragm, and wherein a lower surface of said damper is fixed on a reinforcement portion which is provided by bending a bottom end of said second cylinder outward.

28. The loudspeaker of claim 27, further comprising:

a second damper, wherein the inner circumferential portion of said damper is fixed to an outer circumferential surface of said second cylinder, and wherein an inner circumferential portion of said second damper is fixed to the outer circumferential surface of said second cylinder.

29. The loudspeaker of claim 25, further comprising:

a second damper, wherein said second cylinder is formed of a third cylinder and a fourth cylinder, wherein said fourth cylinder has a diameter greater than that of said third cylinder, wherein a second ring connects said third cylinder to said fourth cylinder, wherein said damper is fixed to said fourth cylinder, and wherein said second damper is fixed to said third cylinder.

30. The loudspeaker of claim 29, wherein a weight-adding member is fixed on an upper surface of said ring and to an outer circumferential surface of said second cylinder.

31. The loudspeaker of claim 25, further comprising a weight-adding member fixed to said ring.

32. A loudspeaker comprising:

a bobbin;

a coil wound around an outer surface of said bobbin;

a magnetic circuit having a magnetic gap in which said coil is inserted;

a first cylinder coupled at an inner circumferential surface thereof with an outer circumference of said bobbin;

a second cylinder coupled with said first cylinder and disposed around an outer circumference of said magnetic circuit;

a diaphragm and a damper both coupled with an outer circumference of said second cylinder;

an edge coupled with said diaphragm;

a frame to which an outer circumference of said damper and an outer circumference of said edge are fixed; and terminals electrically coupled with said coil and fixed to said frame, wherein said bobbin is coupled at an outer circumference thereof in an area lower than said coil with the inner circumferential surface of said first cylinder.

33. A loudspeaker comprising:

a bobbin;

a coil wound around an outer surface of said bobbin;

a magnetic circuit having a magnetic gap in which said coil is inserted;

a first cylinder coupled at an inner circumferential surface thereof with an outer circumference of said bobbin;

a second cylinder coupled with said first cylinder and disposed around an outer circumference of said magnetic circuit;

a diaphragm and a damper both coupled with an outer circumference of said second cylinder;

an edge coupled with said diaphragm;

a frame to which an outer circumference of said damper and an outer circumference of said edge are fixed; and terminals electrically coupled with said coil and fixed to said frame, wherein an outer circumference of a yoke forming said magnetic circuit is provided with a plurality of slits, wherein said first cylinder and said second cylinder are connected by a plurality of joints disposed in a radial direction, wherein said plurality of joints are disposed so that said joints can move within said plurality of slits in a direction of vibration without making contact thereto, wherein two slits, among said plurality of slits, are disposed symmetrically with a center of said terminals as a center of symmetry, and wherein lead wires extending from said voice coil are disposed along said first cylinder or said second cylinder at locations corresponding to said two slits.

* * * * *